US010588410B2

(12) United States Patent
Miles

(10) Patent No.: US 10,588,410 B2
(45) **Date of Patent: *Mar. 17, 2020**

(54) DRAWERS AND COMPONENTS FOR DRAWERS

(71) Applicant: Shane Miles, Arundel (AU)

(72) Inventor: Shane Miles, Arundel (AU)

( * ) Notice: Subject to any disclaimer, the term of this patent is extended or adjusted under 35 U.S.C. 154(b) by 0 days.

This patent is subject to a terminal disclaimer.

(21) Appl. No.: 16/102,923

(22) Filed: Aug. 14, 2018

(65) Prior Publication Data

US 2018/0352952 A1 Dec. 13, 2018

Related U.S. Application Data

(62) Division of application No. 15/534,809, filed as application No. PCT/AU2015/000737 on Dec. 7, 2015, now Pat. No. 10,076,188.

(30) Foreign Application Priority Data

Dec. 10, 2014 (AU) ..... 2014905001
Aug. 13, 2015 (AU) ..... 2015903254

(51) Int. Cl.
*A47B 88/493* (2017.01)
*A47B 88/57* (2017.01)

(52) U.S. Cl.
CPC ..... *A47B 88/493* (2017.01); *A47B 88/57* (2017.01); *A47B 2210/0032* (2013.01); *A47B 2210/0037* (2013.01); *A47B 2210/0043* (2013.01); *A47B 2210/0059* (2013.01)

(58) Field of Classification Search
CPC ..... F25D 23/06; F25D 23/065; A47B 88/493; A47B 88/57; A47B 88/473; A47B 88/477; A47B 88/40; A47B 88/437; A47B 2210/0032; A47B 2210/0037; A47B 2210/0043; A47B 2210/0059
See application file for complete search history.

(56) References Cited

U.S. PATENT DOCUMENTS 2,981,584 A * 4/1961 Friend ..... A47B 88/493 312/334.13
3,574,437 A * 4/1971 Stein ..... A47B 88/487 312/334.19
4,666,221 A * 5/1987 Ernst ..... A47B 88/437 312/334.18

(Continued)

*Primary Examiner* — Daniel J Rohrhoff
(74) *Attorney, Agent, or Firm* — Abelman, Frayne & Schwab

(57) ABSTRACT

A drawer system including: a drawer cabinet and a drawer mounted in said cabinet for forward and backward travel relative thereto; said cabinet having two opposed spaced apart side walls and at least two lower wheels mounted to each side wall and spaced apart in the intended direction of travel of the drawer; said drawer having two opposed spaced apart side panels and at least two lower wheels mounted to each side panel and spaced apart in the intended direction of travel of the drawer; and a runner mounted on said lower cabinet wheels of each side wall for forward and backward travel relative to said cabinet via a first track and each runner including a second track engaged by said spaced apart lower drawer wheels for forward and backward travel for said drawer relative to said runner.

10 Claims, 22 Drawing Sheets

(56) References Cited

U.S. PATENT DOCUMENTS

| | | | | |
|---|---|---|---|---|
| 5,520,452 | A * | 5/1996 | Petersen | A47B 88/57 312/330.1 |
| 10,076,188 | B2 * | 9/2018 | Miles | A47B 88/57 |
| 2003/0173882 | A1 * | 9/2003 | Koons | F25D 23/021 312/404 |
| 2006/0152119 | A1 * | 7/2006 | Park | F25D 23/067 312/404 |
| 2007/0085457 | A1 * | 4/2007 | Park | F25D 23/067 312/402 |
| 2009/0121599 | A1 * | 5/2009 | Laible | F25D 25/025 312/404 |
| 2011/0309732 | A1 * | 12/2011 | Horil | A47B 88/493 312/404 |
| 2012/0262044 | A1 * | 10/2012 | Vulava | F25D 23/021 312/404 |
| 2013/0043780 | A1 * | 2/2013 | Ootsuka | F25D 25/025 312/402 |
| 2013/0313954 | A1 * | 11/2013 | Koelling | A47B 88/40 312/319.1 |

* cited by examiner

DRAWERS AND COMPONENTS FOR DRAWERS

CROSS REFERENCE TO RELATED APPLICATIONS

This application is a divisional application of U.S. application Ser. No. 15/534,809, filed Jun. 9, 2017 which is a national phase of PCT application No. PCT/AU2015/000737, filed Dec. 7, 2015, which claims priority to AU patent application No. 2014905001, filed Dec. 10, 2014, and AU patent application No. 2015903254, filed Aug. 13, 2015, all of which are incorporated herein by reference thereto.

FIELD OF INVENTION

This invention relates to drawers and components for drawers. The invention has particular application to drawers intended for use with heavy loads and drawers or drawer cabinets required for use in dirty or dusty locations. One particular application of the present invention is in drawer cabinets of the type used in vehicles for storing tools, recovery kits, spare parts and the like.

BACKGROUND ART

Drawer cabinets for heavy loads typically include wheels mounted on opposite sides of the drawer and arranged to run on opposed complementary fixed tracks or guides mounted on the inside faces of the opposite sides of the cabinets. Some drawer cabinets have the components reversed with the wheels mounted to the side walls of the cabinet and the tracks or guides mounted to the drawer. However, in both cases, in normal use the drawer cannot be fully drawn from the cabinet because the drawer is support by engagement of the wheels in the tracks or guides and as a result, a significant portion of the drawer remains in the cabinet making access to that portion difficult. The problem is particularly noticeable in drawer cabinets for four wheel drive recreational vehicles and recovery vehicles where limited space is available for a drawer cabinet or drawer cabinets so that the drawer size must be maximised within the cabinet.

Further, it will be appreciated that some equipment is of such a size that while it might fit into a drawer it cannot be put into the drawer unless the whole drawer is accessible from above. Attempts have been made at overcoming the problem of gaining easy access to the whole drawer but they have not been entirely successful. In one such attempt, the drawer includes a fixed track or guide which runs on a wheel mounted to another track which in turn runs on another track which is fixed to the cabinet so that part of the intermediate track can extend beyond the cabinet and the drawer can be supported by the intermediate track. However, while more of the drawer can be accessed more easily than in single track or runner systems, such systems still do not provide full open access.

Another drawer slide system which has been relatively successful in providing better drawer access utilises an intermediate track which slides on bearing balls held in a longitudinal rack which supports the intermediate track over a substantial length. However, in typical rack systems the balls necessarily are arranged to run in grease as they roll along the track and in dusty or dirty conditions the grease becomes impregnated with dirt, sand, water and the like thereby causing damage and jamming the slides. Moreover, even if immediate damage is avoided the balls and the tracks have to be regularly cleaned and regreased to ensure reliability. Additionally, such presently available systems cannot carry the heavy equipment loads required for long range outback 4WD journeys.

SUMMARY OF THE INVENTION

The present invention is aimed at providing drawers and slides for drawers which allows drawers to be fully accessible or at least almost fully accessible in a cabinet while at the same time being able to bear heavy loads and to be relatively maintenance free.

With the foregoing in view, the invention in one aspect resides broadly in a drawer system including:

a drawer cabinet and a drawer mounted in said cabinet for forward and backward travel relative thereto;

said cabinet having two opposed spaced apart side walls and at least two lower wheels mounted to each side wall and spaced apart in the intended direction of travel of the drawer;

said drawer having two opposed spaced apart side panels and at least two lower wheels mounted to each side panel and spaced apart in the intended direction of travel of the drawer;

a runner mounted on said lower cabinet wheels of each side wall for forward and backward travel relative to said cabinet via a first track and each runner including a second track engaged by said spaced apart lower drawer wheels for forward and backward travel of said drawer relative to said runner.

In another aspect the invention resides broadly in a drawer system including:

a drawer cabinet and a drawer mounted in said cabinet for forward and backward travel relative thereto;

said cabinet having two opposed spaced apart side walls and at least two lower wheels mounted to each side wall and spaced apart in the intended direction of travel of the drawer;

said drawer having two opposed spaced apart side panels and at least two lower wheels mounted to each side panel and spaced apart in the intended direction of travel of the drawer;

a runner mounted on said lower cabinet wheels of each side wall for forward and backward travel relative to said cabinet, each runner including a track engaged by said spaced apart lower drawer wheels for forward and backward travel of said drawer relative to said runner;

first stop means on said cabinet side walls and/or said runners for stopping travel of said runners relative to said side walls respectively at a predetermined position; and second stop means on said runners and/or said side panels for stopping travel of said side panels relative to said runners respectively at a predetermined position.

Preferably, said spaced apart side walls of said cabinet include upper guide means on or mounted to each side wall and spaced above said lower wheels thereof and adapted to engage with complementary guide means on or mounted to said runner. It is also preferred that said spaced apart side panels of said drawers include upper guide means mounted to or on each side panel and spaced above said lower wheels thereof and adapted to engage with complementary guide means on or mounted to said runner.

In another aspect, the invention resides broadly in a drawer system including:

a drawer cabinet and a drawer mounted in said cabinet for forward and backward travel relative thereto;

said cabinet having two opposed spaced apart side walls and at least two lower wheels mounted to each side wall and spaced apart in the intended direction of travel of the drawer and upper guide means on or mounted to each side wall and spaced above said lower wheels thereof;

said drawer having two opposed spaced apart side panels and at least two lower wheels mounted to each side panel and spaced apart in the intended direction of travel of the drawer and upper guide means on or mounted to each side panel and spaced above said lower wheels;

a runner mounted on said lower cabinet wheels of each side wall for forward and backward travel relative to said cabinet, each runner including a track engaged by said spaced apart lower drawer wheels for forward and backward travel of said drawer relative to said runner;

first stop means on said cabinet side walls and/or said runners for stopping travel of said runners relative to said side walls respectively at a predetermined position; and second stop means on said runners and/or said side panels for stopping travel of said side panels relative to said runners respectively at a predetermined position.

In yet another aspect, the invention resides broadly in a drawer system including:

a drawer cabinet and a drawer mounted in said cabinet for forward and backward travel relative thereto;

said cabinet having two opposed spaced apart side walls and at least two lower wheels mounted to each side wall and spaced apart in the intended direction of travel of the drawer and upper guide means on or mounted to each side wall and spaced above said lower wheels thereof;

said drawer having two opposed spaced apart side panels and at least two lower wheels mounted to each side panel and spaced apart in the intended direction of travel of the drawer and upper guide means on or mounted to each side panel and spaced above said lower wheels;

a runner mounted on said lower cabinet wheels of each side wall for forward and backward travel relative to said cabinet, each runner including a track engaged by said spaced apart lower drawer wheels for forward and backward travel of said drawer relative to said runner, and said runner including complementary guide means adapted to cooperate with said upper guide means of said cabinet and said upper guide means of said drawer to guide said runner and said drawer relative to said cabinet;

first stop means on said cabinet side walls and/or said runners for stopping travel of said runners relative to said side walls respectively at a predetermined position; and second stop means on said runners and/or said side panels for stopping travel of said side panels relative to said runners respectively at a predetermined position.

In another aspect, the invention resides broadly in a drawer system including a cabinet side wall and a drawer side panel in combination with a runner, said cabinet side wall having at least two lower wheels spaced apart in the direction of travel of the drawer and upper guide means spaced above said lower wheels;

said drawer side panel having at least two lower wheels spaced apart in the intended direction of travel of the drawer and upper guide means spaced above said lower wheels;

said runner being adapted to be mounted on said lower wheels of said cabinet side wall for forward and backward travel relative to said cabinet side wall, said runner including a track adapted to be engaged by said spaced apart lower drawer wheels for travel of said drawer relative to said runner;

first stop means on said cabinet side wall or said runner for stopping travel of said runner relative to said side wall at a predetermined position; and second stop means on said runner or said side wall for stopping travel of said side panel relative to said runner at a predetermined position.

In another aspect, the invention resides broadly in an elongate side wall for a cabinet, said side wall having a recess adapted to at least partially receive therein a runner and two or more longitudinally spaced apart lower wheels mounted on one side of said recess for supporting a runner thereon and guide means on the opposite side of said recess for guiding a runner travelling in said recess on said lower wheels.

In yet another aspect, the invention resides broadly in an elongate side panel for a drawer, said side panel having at least two lower wheels spaced apart in the intended direction of travel of the drawer and adapted to roll along a track provided in a runner and upper guide means spaced above said lower wheels for guiding travel of said side panel along the runner.

In still yet another aspect, the invention resides broadly in a runner for movably connecting a drawer to a cabinet, said runner including a first track adapted to run on two spaced apart lower wheels mounted on a cabinet side wall for forward and backward travel relative to said cabinet side wall, said runner also including a second track adapted to be engaged by two spaced apart lower wheels mounted on a drawer side panel for travel of the drawer relative to the runner.

Suitably, said upper guide means of said cabinet are intended to firstly guide movement of the runner relative thereto in a straight line in and out of the cabinet and secondly to inhibit tilting of the runner relative to the cabinet. Similarly, said upper guide means of said drawer are intended firstly to guide movement of said runner relative to said drawer so that the runner moves in and out of the cabinet relative to the drawer in a straight line also and secondly to inhibit tilting of said runner relative to said drawer.

Preferably, said runner is mounted on said lower cabinet wheels via an outer bottom track provided on the runner. In such form, it is preferred that the outer bottom track be provided in an elongate recess or channel (which may be referred to herein as either) in the runner and defined at least in part by an inner side face arranged to provide an abutment adapted to engage the outer side face of the lower cabinet wheels if they attempt to run off the true line for forward and back travel relative to the cabinet. In one such particularly preferred form, the elongate recess or channel is defined by two spaced apart opposed inner side faces adapted to engage the opposed spaced apart outside faces of the lower cabinet wheels if they attempt to run off the true line one way or the other for forward and back travel relative to the cabinet as well as a downward directed face providing the outer bottom track between the inner and outer faces on which the wheels roll. Preferably, the opposed spaced apart inner side faces are substantially parallel to each other and substantially orthogonal to the downward directed face forming the outer bottom track so that the recess is substantially "U" shaped in cross section.

Preferably, the upper guide means of said cabinet (or said cabinet side walls) includes at least one wheel mounted to said side wall and more preferably at least two wheels (guide wheels) spaced apart in the same manner as the lower cabinet wheels and generally in a horizontal line vertically above them. In such form of the invention it is preferred that the guide wheels follow an upward facing track on the runner which is substantially aligned vertically with the downward directed track on the runner followed by the cabinet lower wheels. It is also preferred that the upward facing track be provided in a recess in the same manner as the outer bottom track but opening upwards instead of downwards with an upward directed face forming the track for the guide wheels (the outer top track).

Preferably, the track on the runner followed by the lower drawer wheels is substantially aligned vertically with the track on the runner followed by the lower cabinet wheels so that the load of the drawer and contents thereof is transmitted directly through the runner onto the cabinet lower wheels more or less in the same vertical plane thus decreasing cantilever loads.

Preferably, the upper guide means of said drawer (or the side panel of said drawer) includes at least one wheel mounted to said side panel and more preferably at least two wheels spaced apart in the same manner as the lower wheels and generally above them but not necessarily directly above them. In such form of the invention it is preferred that the guide wheels follow a track on the runner which is substantially aligned vertically with the track on the runner followed by the drawer lower wheels. In a particularly preferred form, the outer bottom track on the runner followed by the cabinet lower wheels, the outer top track on the runner followed by the cabinet guide wheels, the inner bottom track on the runner followed by the drawer lower wheels and the inner top track followed by the drawer guide wheels are all aligned vertically, that is to say, that the centre lines of travel of all wheels on one side of the cabinet and drawer lie in the same vertical plane. It will be appreciated that in such form of the invention, the runner is symmetrical about a horizontal plane through the longitudinal centre line of the runner whereby the runners for both sides of the cabinet are interchangeable and can be cut from the same extrusion. It is also preferred that all four tracks on the runner be provided in recesses of substantially "U" shaped form with the faces on which the wheels run all being aligned vertically.

Preferably, at least some of the wheels are ball or roller bearings having an inner race which is mounted on a shaft secured to the cabinet or drawer or runner as the case may be and an outer race of which the outer face forms the rolling surface on the relevant track. However, other types of wheels may be suitable. In a preferred form, all wheels are ball bearings which are mounted on fixed shafts.

In yet another aspect, the invention resides broadly in a drawer system adapted to be mounted in a motor vehicle, including:

a drawer cabinet and a drawer mounted in said cabinet for forward and backward travel relative thereto and holding means for holding said drawer in a predetermined position relative to said cabinet;

said holding means including a pair of halves adapted to engage with each other to hold said drawer in said predetermined position, one of said halves being mounted on or secured to said cabinet and the other half being mounted on or secured to said drawer for movement therewith and the pair of halves being arranged so that the halves engage upon application of a predetermined opening force applied to the drawer in one direction and disengage upon application of a predetermined closing force applied to the drawer in the opposite direction.

Preferably, one of said pair of halves includes a wheel or the like and the other includes a hump or recess and the predetermined opening force is a force sufficient to force said wheel over said hump or into said recess and the predetermined closing force is a force sufficient to force the drawer over the hump or out of the recess in the other direction. Advantageously, the drawer system with the holding means provides a mechanism which allows a person to access an open drawer safely when the vehicle in which it is mounted is parked on a slope.

In yet another aspect, the invention resides broadly in a drawer system adapted to be mounted in a motor vehicle, including:

a drawer cabinet and a drawer mounted in said cabinet for forward and backward travel relative thereto;

lighting means mounted in said drawer or said cabinet and arranged to light the interior of said drawer at a predetermined drawer position;

switching means operatively connected to said lighting means for switching said lighting means on upon said drawer reaching said predetermined position and off upon said drawer leaving said predetermined position;

said switching means including a pair of electrical contact means, said pair of contact means including a first contact half on or secured to said cabinet and a complementary second contact half on or secured to said drawer for movement therewith, said lighting means being in electrical communication with said second contact half whereby electrical current can flow from said first contact half to said second contact half when said drawer has reached the predetermined position to energise said lighting means.

Preferably, said switching means includes two pair of electrical contact means with one pair being arranged to electrically connect the negative side of the lighting means and the other to electrically connect the positive side of the lighting means to thereby energise the lighting means. While it is possible for switching means with only one electrical contact means to be used to switch on one side of the lighting means only, advantageously, use of the contact on each electrical side obviates the need for any wires to move with the drawer.

Preferably, said switching means is mounted to or integral with holding means as previously described. In a preferred form, where the holding means includes a wheel on the drawer, it is preferred that the wheel include at least a part which is electrically conductive over the full circumference so that contact can be made with a complementary contactor half in the recess or on the hump at any circumferential position of the wheel.

In this specification, terms such as vertical and horizontal, above and below, inside and outside, upper and lower, top and bottom and similar orientation terms are used to refer to various components and features when the drawer system is in its normal in use position for the purpose of providing a clear description of the invention and are not intended to limit the use of the drawer system to any particular orientation. Similarly, unless the context clearly requires otherwise, the term "half" used herein when referring to electrical contacts or holder components is not intended to refer to pure mathematical halves but rather to components in which two mating components are required to engage to achieve the function described.

BRIEF DESCRIPTION OF THE DRAWINGS

In order that the invention may be more easily understood and put into practice reference will now be made to the accompanying drawings wherein.

DETAILED DESCRIPTION OF THE INVENTION

Figure 1:
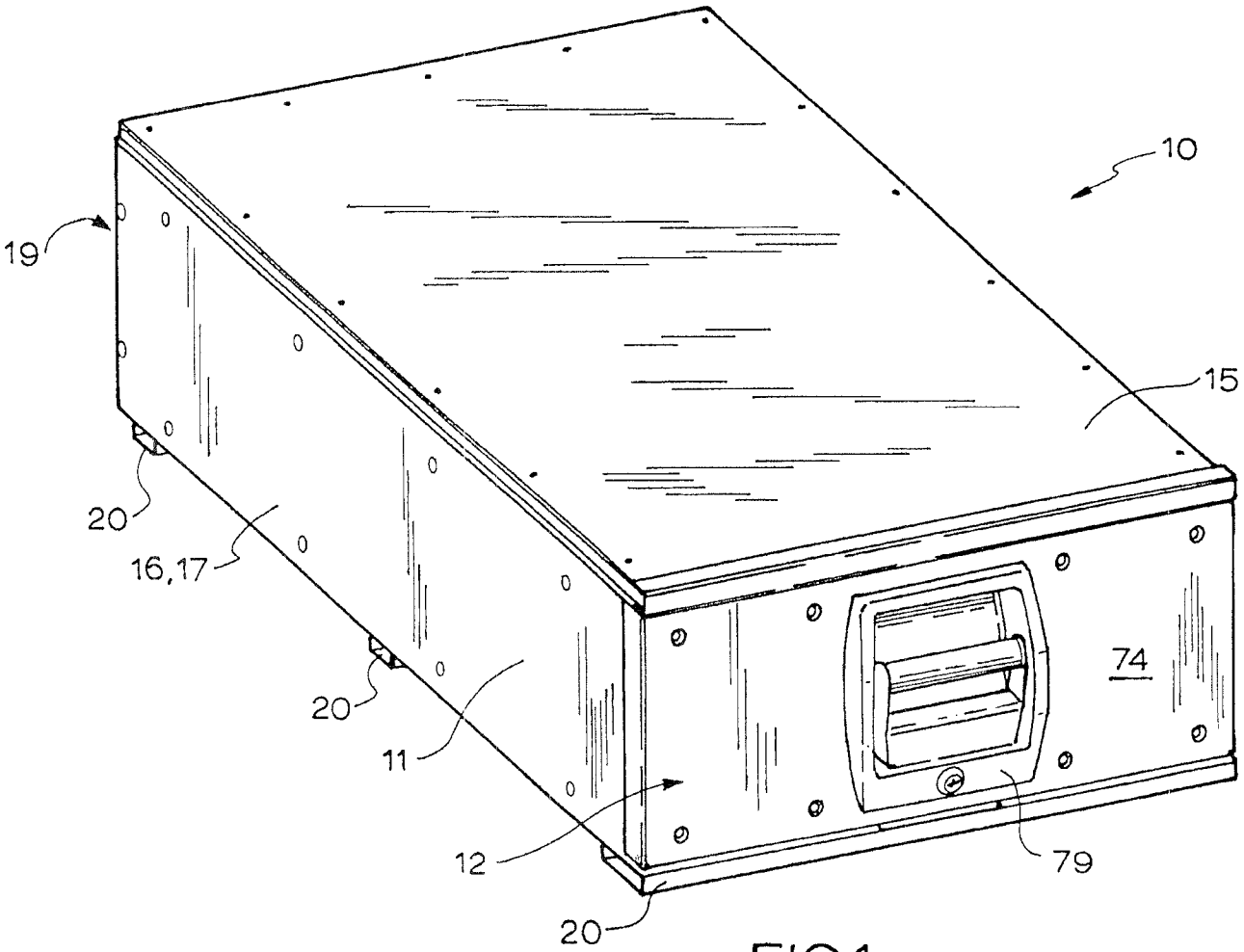
FIG. 1 is a pictorial representation of a single drawer cabinet system according to the invention.

The drawer cabinet 10 illustrated in FIG. 1 includes a cabinet shell 11 and a drawer 12 mounted therein for forward and backward travel into and out of the shell on a runner 13 as will be explained in more detail later.

The shell comprises a bottom wall panel 14, an opposed upper wall panel 15 spaced from the bottom wall panel and two spaced apart side wall panels 16 and 17 (not visible in FIG. 1 or FIG. 2) as well as a back wall panel 19 which are secured together by screw threaded fasteners shown typically at 21 and 22 which engage in complementary screw threaded holes shown typically at 23, 24 and 25. In that respect, the bottom wall has an upwardly extending return 27 which allows screws 21 to secure the base panel to the side wall panels in a horizontal disposition thereby putting the screws under a shear load rather than a tensile load. The bottom wall is supported on spaced apart cross members 20 which extend laterally of the cabinet and support the floor panel a small distance above the floor of the vehicle to which the cabinet system is to be fitted.

The side wall panels 16 and 17 are aluminium extrusions cut from the same length and are each are provided with lower and upper recesses 31 and 32 extending longitudinally in the direction of drawer travel as well as a large intermediate longitudinally extending recess 33 which is separated from the lower and upper recesses by longitudinally extending ribs 34 and 36 respectively for a purpose which will become clearer later. Two spaced apart lower wheels 41 and 42 are mounted to the lower rib 34 in longitudinally spaced apart relation for rotation on respective fixed shafts 40 and extend upwards into the large recess 33. Similarly, two longitudinally spaced apart upper wheels 43 and 44 are mounted to the upper rib 36 on other fixed shafts 40 and extend downwards into the large recess.

The runner 13 is an aluminium extrusion and has two downward and upward facing spaced apart longitudinally running lower and upper recesses (or grooves) 51 and 52 which are adapted to receive therein the lower wheels 41, 42 and the upper wheels 43, 44 respectively for travel forwards and backwards therealong relative to the shell. The runner also has a centre longitudinally running recess 53 which opens inwards towards the drawer and two more spaced apart downward and upward facing recesses (or grooves) 54 and 55 respectively open from recess 53 in vertical alignment with the outer recesses 51 and 52 for a purpose which will become clearer later.

The drawer 12 includes a bottom wall panel 70 which is similar to the bottom wall panel 14 of the shell and two spaced apart side wall panels 71 and 72 (not visible in FIG. 1) similar to side wall panels 16 and 17 of the shell as well as a back wall panel 73 (not shown) and a front panel 74. A latch draw handle 79 is mounted in and secured to the front panel by threaded fasteners.

The side wall panels 71 and 72 are aluminium extrusions and each have an outwardly protruding and longitudinally extending bottom stiffening portion 76 which is adapted to run within the lower recess 31 of the shell sidewall and also an outwardly protruding and longitudinally extending upper stiffening rib 77 which is similarly adapted to run within the recess 32 provided in the shell sidewall. Advantageously, the bottom stiffening portion 76 and the upper stiffening rib 77 together with the recesses 31 and 32 allow the drawer and the shell to inter-engage thereby minimising the space taken up by the shell and the drawer walls while maintaining the necessary stiffness and strength of both panels. A number of screw threaded holes are provided in the side wall panels for securing the front panel and the bottom panel thereto in much the same manner as for the shell 12.

Two longitudinally spaced apart lower wheels 81 and 82 and two similar longitudinally spaced apart upper wheels 83 and 84 are mounted on the outside of the side wall panels 71 and 72 and arranged to run in the respective inner recesses 54 and 55 respectively so that the drawer can travel forwards and backwards relative to the runner 13.

It will be appreciated that the outer recesses 51 and 52 and the inner recesses 54 and 55 provide "tracks" for the wheels and all tracks are provided in the runner. Advantageously, the runner can be removed and cleaned or replaced if necessary in a simple operation which results in all new tracks.

It will be appreciated that in use, the drawer 12 can "slide" forward (outwards) relative to the shell by the lower rollers 81 and 82 rolling along the runner in the lower recess 54 while at the same time or before or after the runner can roll forward relative to the shell by way of "rolling" along the lower rollers 41 and 42 which are secured to the shell side panels 16 and 17. Stoppers (not shown will limit movement of the drawer relative to the runner 13 when the rollers 81 and 82 hit the stopper and similarly movement of the runner will be limited by a stopper when the runner fits the stopper. Consequently, the total forward movement of the drawer relative to the shell will be limited by the distance between the lower wheels 81 and 82 of the drawer and the distance between the lower wheels 41 and 42 of the shell and the length of the runner and the drawer. Thus, as the length of the runner and the length of the drawer can be almost the same as the length of the cabinet, the total distance of travel can be greater than the length of the drawer thereby allowing the whole of the drawer to move forward beyond the front of the shell so as to provide full access to the drawer.

Figure 2:
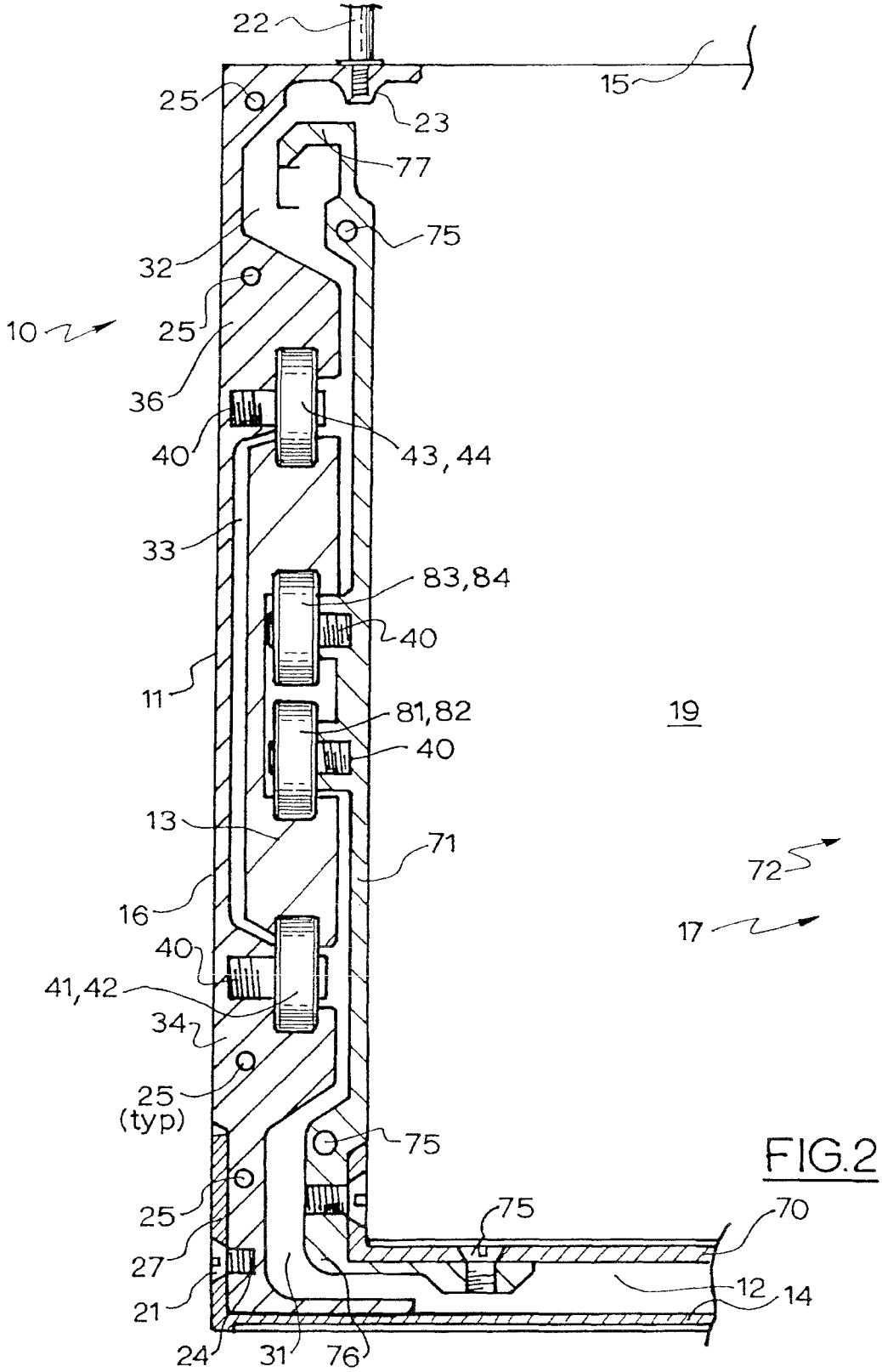
FIG. 2 is a sectional front elevation of part of the single drawer cabinet system of FIG. 1 through one side showing one side wall of the cabinet or cabinet shell and one side panel of the drawer mounted therein on a runner.
Figure 4:
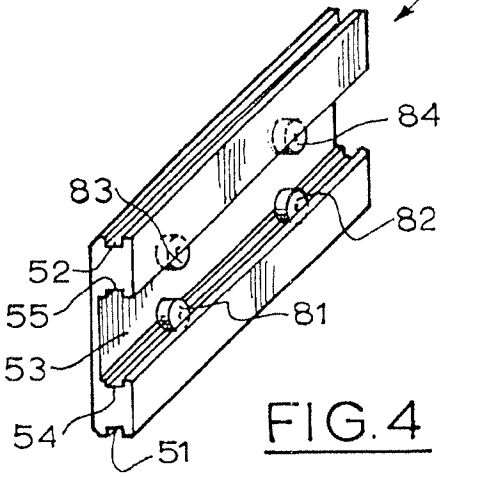
FIG. 4 is an oblique view of the runner of the cabinet system of FIG. 1.
Figure 3:
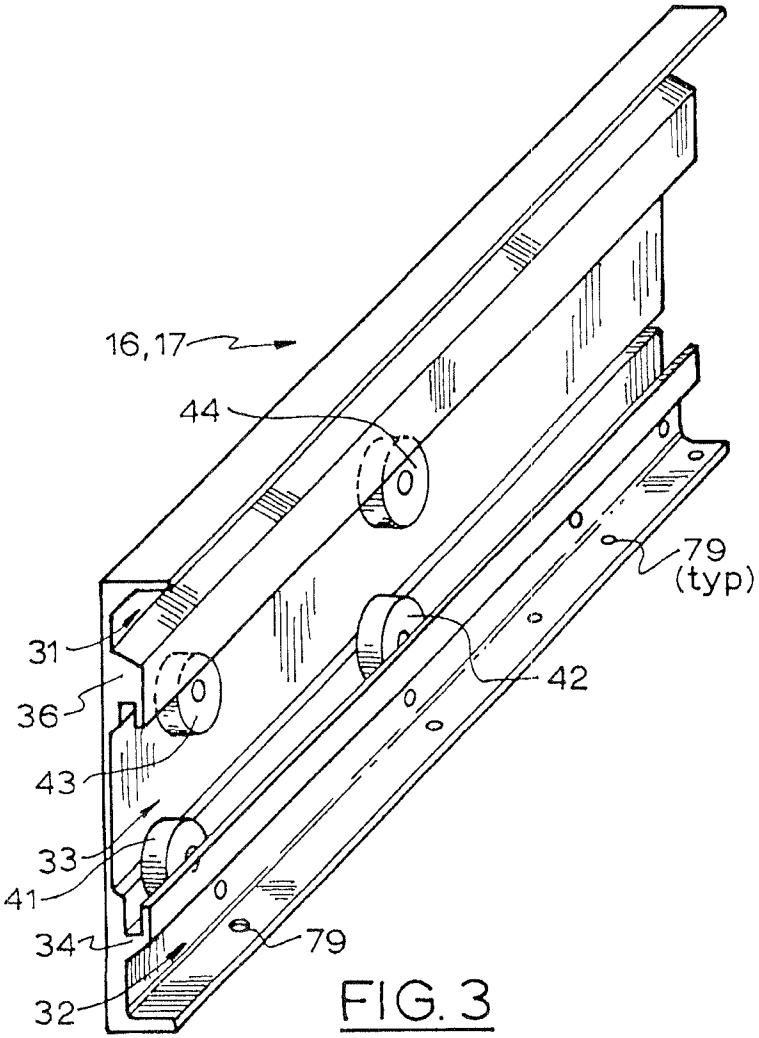
FIG. 3 is an oblique view of the side wall of the cabinet shell of the cabinet system of FIG. 1.
Figure 5:
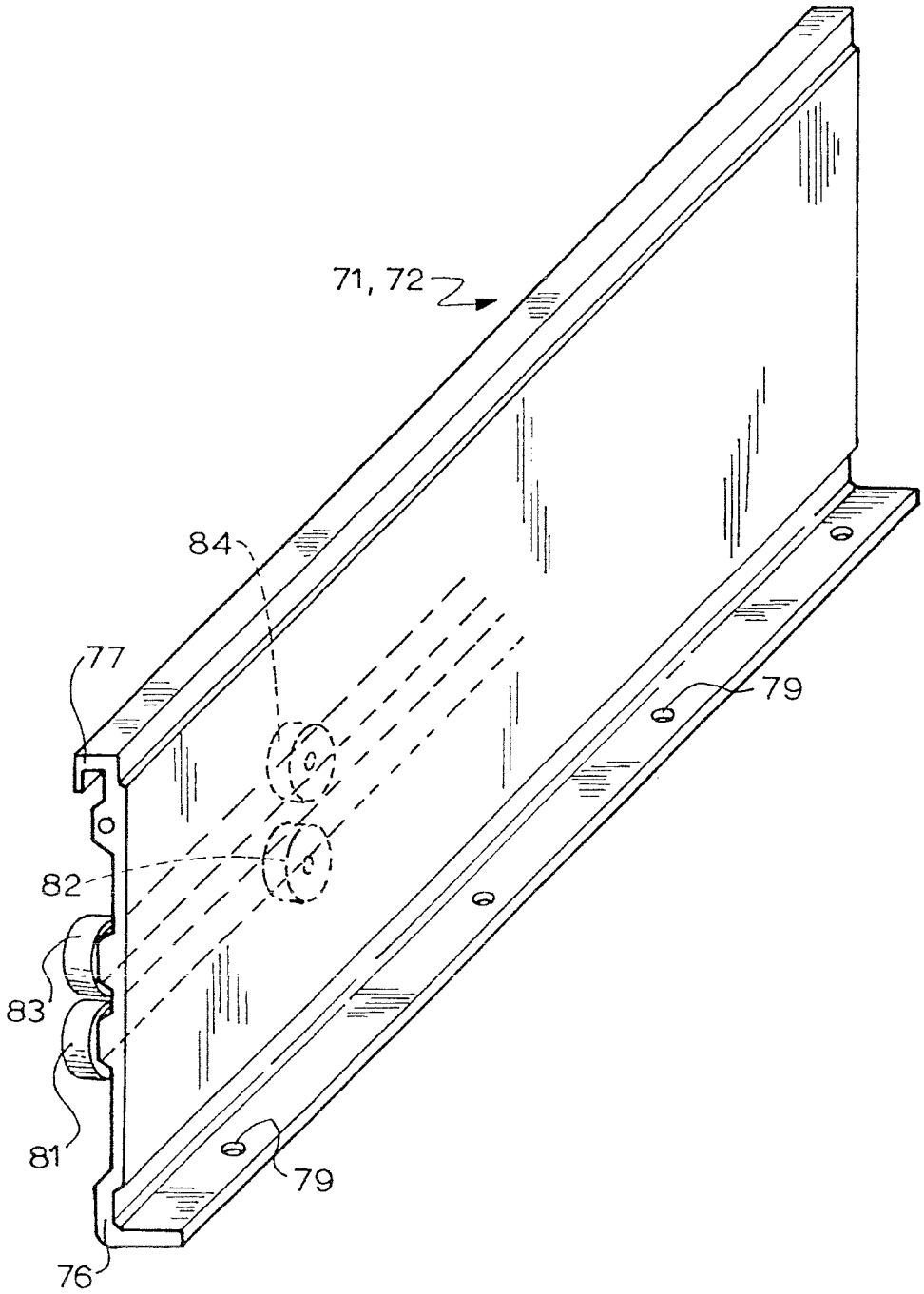
FIG. 5 is an oblique view of the side wall of the drawer of the cabinet system of FIG. 1.
Figure 6:
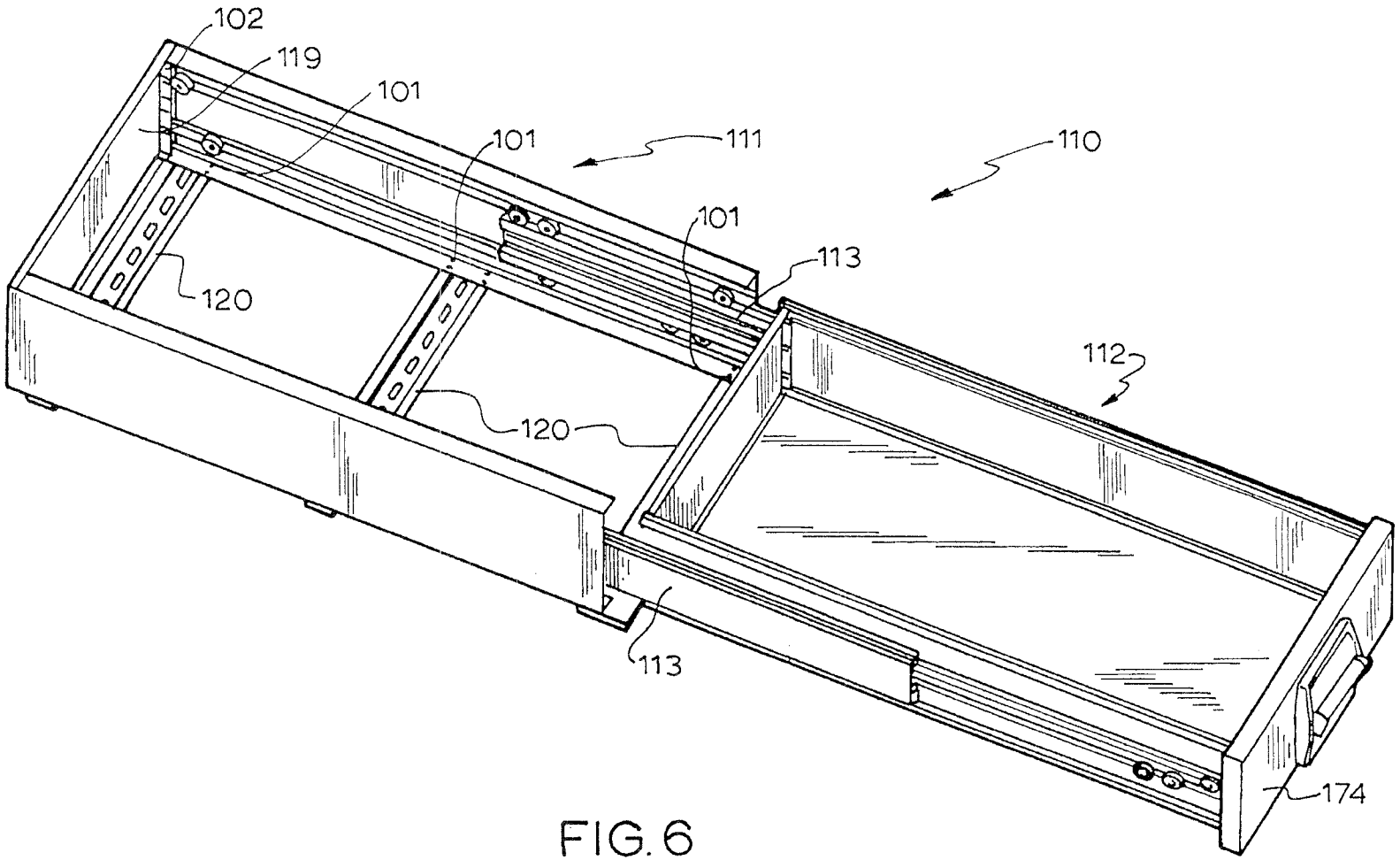
FIG. 6 is a pictorial representation of another single drawer cabinet system according to the invention with the drawer fully open.

The drawer cabinet system 110 illustrated in FIG. 6 is similar to the drawer illustrated in FIG. 1 and accordingly the same item numbers will be used to reference corresponding components or features where possible except prefaced by a "1". The cabinet system 110 like drawer system 10 includes a cabinet shell 111 and a drawer 112 mounted therein for forward and backward travel into and out of the shell on a runner 113.

Figure 7A:
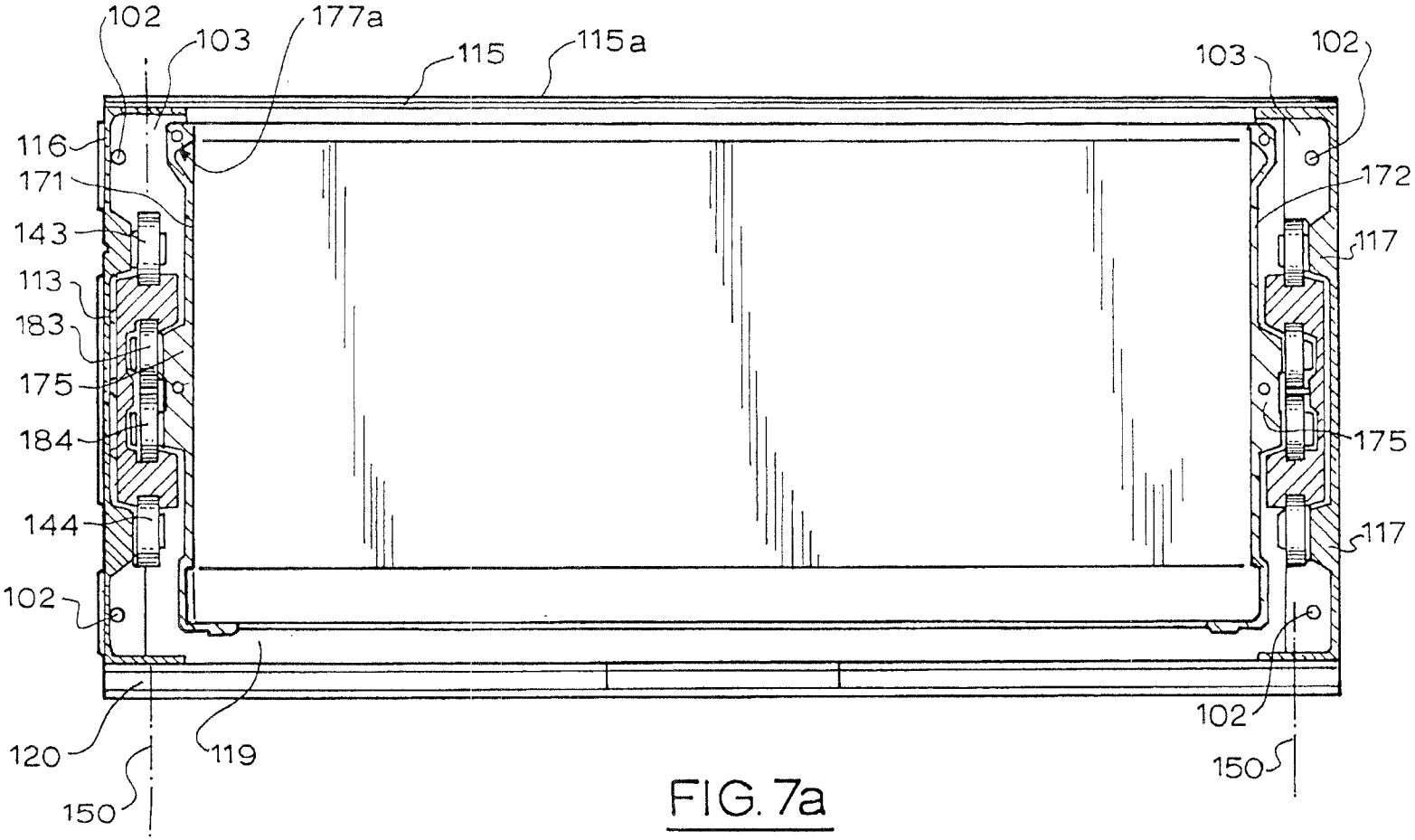
FIG. 7*a* and FIG. 7*b* are sectional front elevations of part of the single drawer cabinet system of FIG. 6.
Figure 7B:
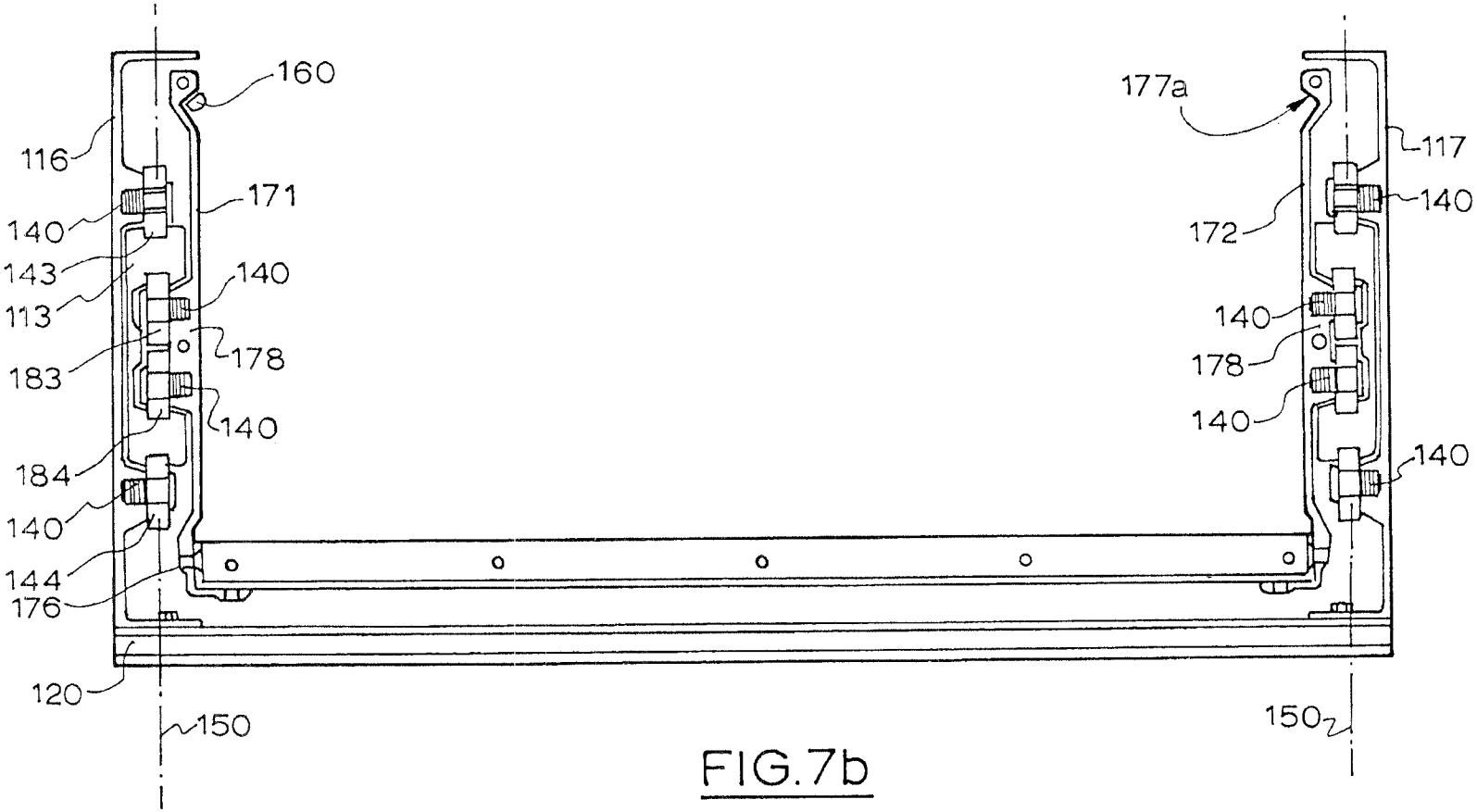

In this case, the shell includes three spaced apart cross members 120 but no bottom wall panel as in cabinet 10, and the two spaced apart side wall panels 116 and 117 are fastened directly to the cross members by fasteners 101 which in this case are screws while in other cases pop rivets are used. The back wall panel 119 is secured to the side wall panels by threaded fasteners passing through holes 102 provided in both legs of an angle bracket 103 fitted in the respected corners as can be seen in FIG. 7 instead of being screwed directly into screw flutes in the rear ends of the side wall panels as in the cabinet system of FIG. 1. As can be seen in FIG. 7, the upper wall panel 115 is a sheet of flat aluminium instead of ply type timber which is secured to the side wall panels in the same manner as the timber sheet in FIG. 1 but in this case the aluminium sheet is covered by a layer of carpet for the purpose of decreasing cabinet noise travel and for aesthetic appeal.

The cabinet side wall panels 116 and 117 of cabinet system 110 are also aluminium extrusions and have lower and upper recesses 131 and 132 extending longitudinally in the direction of drawer travel as well as a large intermediate longitudinally extending centre recess 133 which is separated from the lower and upper recesses by longitudinally extending ribs 134 and 136 respectively.

Figure 8:
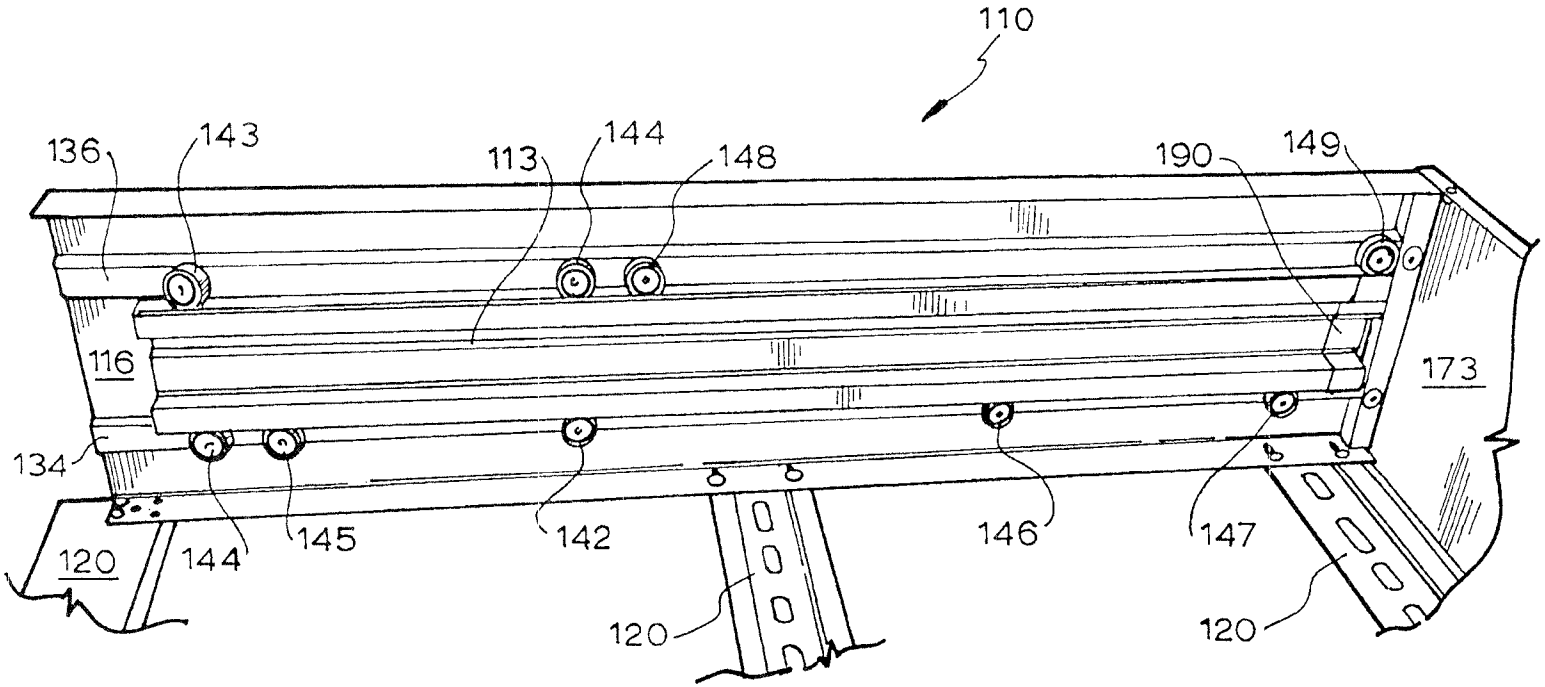
FIG. 8 is a pictorial representation of part of the cabinet shell of the system of FIG. 6 with the drawer removed for clarity and one runner shown fully retracted but with the outer end stopper mechanism removed.
Figure 9:
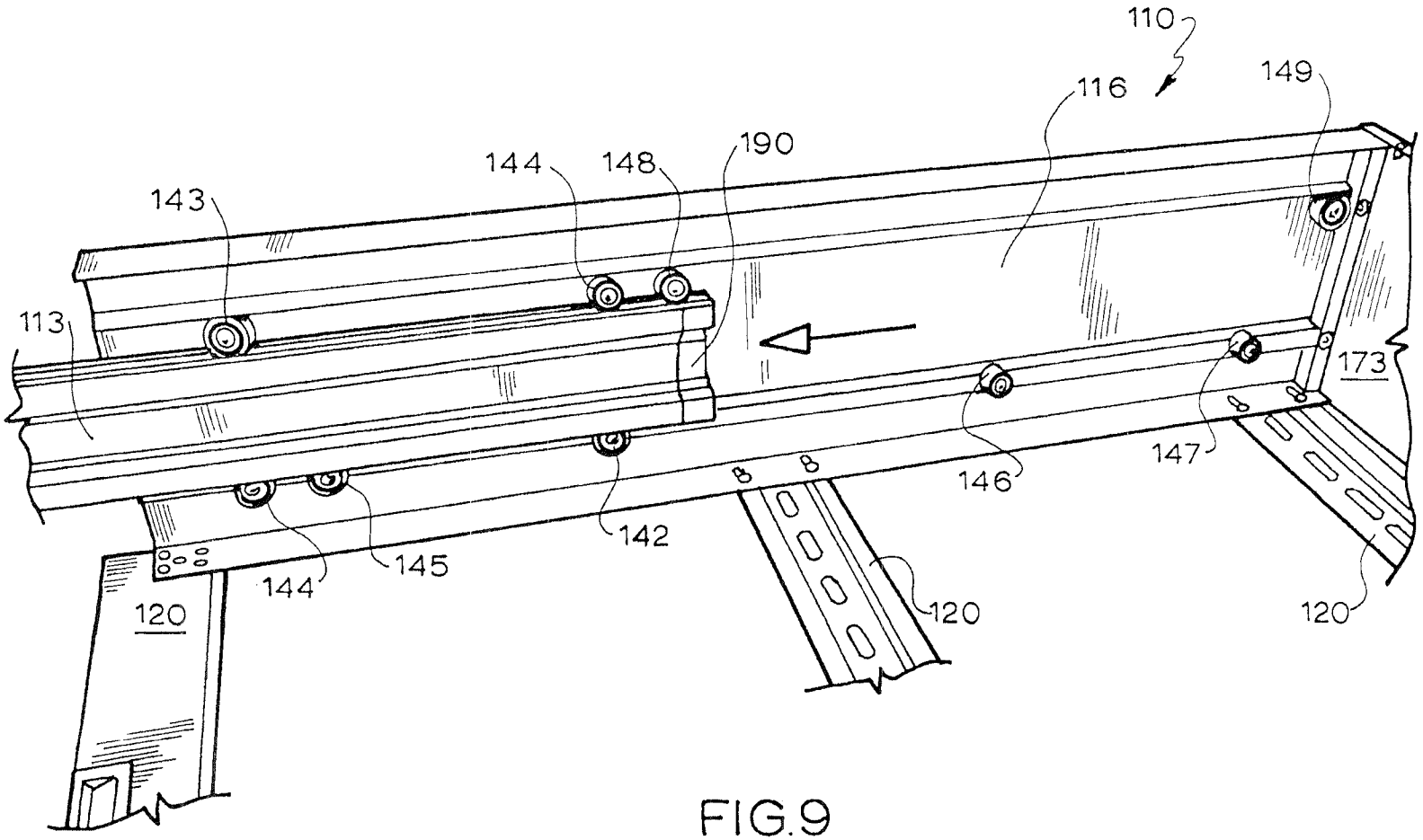
FIG. 9 is a pictorial representation of part of the cabinet shell of the system of FIG. 6 with the drawer removed for clarity and the runner fully extended or drawn.
Figure 10:
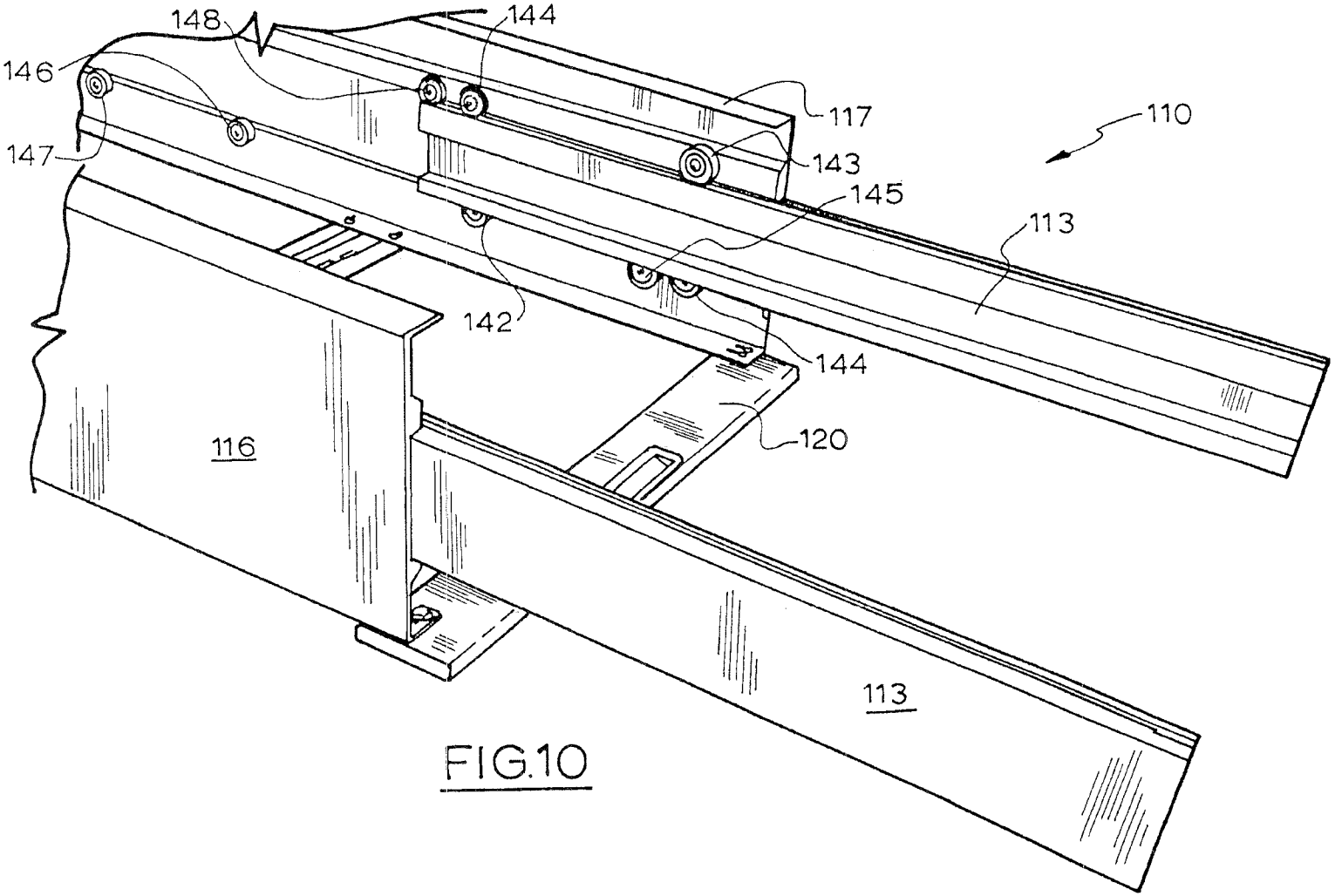
FIG. 10 is a pictorial representation of part of the cabinet shell of the system of FIG. 6 with the drawer removed for clarity and both runners fully extended.

Cabinet system 110 has two spaced apart lower cabinet wheels 141 and 142 mounted to the lower rib 134 in longitudinally spaced apart relation and two spaced apart upper cabinet wheels 143 and 144 mounted to upper rib 136 in much the same manner as the lower wheels 41 and 42 and the upper wheels 43 and 44 of cabinet system 10. Cabinet system 110 also has additional lower wheels 145, 146 and 147 also mounted to lower rib 134 as can be seen in FIG. 8. Advantageously, lower wheel 147 is mounted towards the rear wall panel 119 and supports the rear end portion of the runner when the drawer is fully closed thereby reducing the upward moment load on upper front wheel 143 during travel. Additional wheel 146, like wheel 142, is located intermediate the rear end lower wheel 147 and the front end wheel 144 to help share the load of the drawer particularly during off road travel. In that respect, it will be appreciated that drawer systems for four wheel drive and other off road vehicles are expected to carry heavy loads under rough conditions. Additional wheel 145 adjacent front wheel 144 is intended to share the load normally taken only by the front wheel and particularly when the drawer is fully extended.

As can be seen in FIG. 8, cabinet system 110 also includes two additional upper cabinet wheels 148 and 149, wheel 148 being intermediate the opposite ends of the cabinet side panels and wheel 149 being adjacent the rear end. Upper rear wheel 149 is arranged to engage with a stopper mechanism to stop movement of the runner (and the drawer mounted thereto) into the cabinet at a predetermined "closed" position as will be described in more detail later for the purpose of stopping travel of the drawer and is not intended to bear any significant moment load.

The runner 113 is also an aluminium extrusion and is substantially the same as runner 13. In that respect, it has two outer facing spaced apart longitudinally running lower and upper substantially "U" shaped recesses (or grooves) 151 and 152, that is to say, recess 151 opens downwards and recess 152 opens upwards. The lower recess is arranged to receive therein the lower cabinet wheels 141 and 142 while the upper recess is arranged to receive the upper wheels 143 and 144 respectively for travel forwards and backwards therealong relative to the cabinet shell. For that purpose, the bottom face of the upper recess provides a track for the upper cabinet wheels and the top face of the lower recess provides a track for the lower cabinet wheels. Advantageously, as can be seen in FIG. 7 the upper and lower cabinet wheels are vertically aligned and the wheels on each side are centred on centre lines 150 respectively so that they follow tracks the centre lines of which lie in the same vertical plane centred on the centre lines 150 respectively as is the case with cabinet system 10.

The runner 113 also has a longitudinally running centre recess 153 which opens inwards towards the drawer (that is, towards the opposite side of the cabinet) and two opposed spaced apart longitudinally running substantially "U" shaped recesses 154 and 155 open into recess 153 in vertical alignment with the outer recesses 151 and 152. That is to say, recess 154 opens upwards into recess 153 and recess 155 opens downwards into recess 153 in the same manner as recesses 54 and 55 described earlier in relation to system 10. It will be appreciated that alignment of the tracks in recesses 154 and 155 with each other and with the tracks in recesses 151 and 152 allows all wheels on each side of the cabinet drawer system to run along respective centre lines contained in the same vertical plane.

In another embodiment, which will be described in more detail later, the U-shaped bottom face (or track face) of each recess is arcuate in cross section (concave from the opening), preferably semi-circular in cross section and the wheels have a complimentary cross section shape. Such form of the invention in some cases provides better tracking of the drawer along the tracks and reduces the incidence of the wheels . . . against the sides of the recesses. Further, in such embodiments, the sides of the recesses are tapered preferably slightly away from the bottom face or spaced slightly further to give clearance for the sides of the wheels.

In yet another embodiment, the arcuate cross sections are revered so that the bottom face of the recess is convex from the opening to provide a high outer line. However, such form could result in a build-up of debris along the edges of the track.

The drawer 112 includes a bottom wall panel 170 and two spaced apart side wall panels 171 and 172 which are also aluminium extrusions similar to side wall panels 16 and 17 of the cabinet shell as well as a back wall panel 173 and a front panel 174 which are also aluminium extrusions although in the drawings, the front panel is covered on the outside by a layer carpet. The side wall panels 171 and 172 are cut from the same extrusion and are thus mirror images of each other.

Each side wall panel has an outwardly protruding and longitudinally extending bottom stiffening portion 176 which is adapted to run within the lower recess 131 of the cabinet shell sidewall although not as far into the recess and also an outwardly protruding and longitudinal extending upper stiffening rib 177 which is similarly adapted to run within the recess 132 provided in the shell sidewall although again not as far into the recess as in drawer system 10. Rather, drawer side wall panels 171 and 172 each have a thickened centre portion 178 extending over its full length to which the load bearing wheels are mounted as will be described later. Notably, the thickened centre portion "nests" to some extent within recess 153 of the runner 113 while the runners themselves nest to some extent within recesses 133 of the cabinet side walls 116 and 117 respectively as can be seen more clearly in FIG. 7. Advantageously, the ribs, thickened centre portion and complementary recesses of the cabinet side walls, the runners and the drawer side panels allow the three components to inter-engage or nest thereby minimising the space taken up by the shell and the drawer walls while maintaining the necessary stiffness and strength of all three components so that usable drawer space can be maximised while maintaining satisfactory strength and operational stability.

A number of screw threaded nut inserts shown typically as item 179 are provided in the side wall panels for securing the front panel and the bottom panel thereto in much the same manner as for the shell 12.

Two longitudinally spaced apart lower wheels 181 and 182 and two similar longitudinally spaced apart upper wheels 183 and 184 are mounted on the outside of the thickened side wall panels 171 and 172 and arranged to run in the respective inner recesses 154 and 155 of the runner 113 respectively so that the drawer can travel forwards and backwards relative to the runner in much the same manner as wheels 81 to 84 of cabinet system 10.

Figure 12:
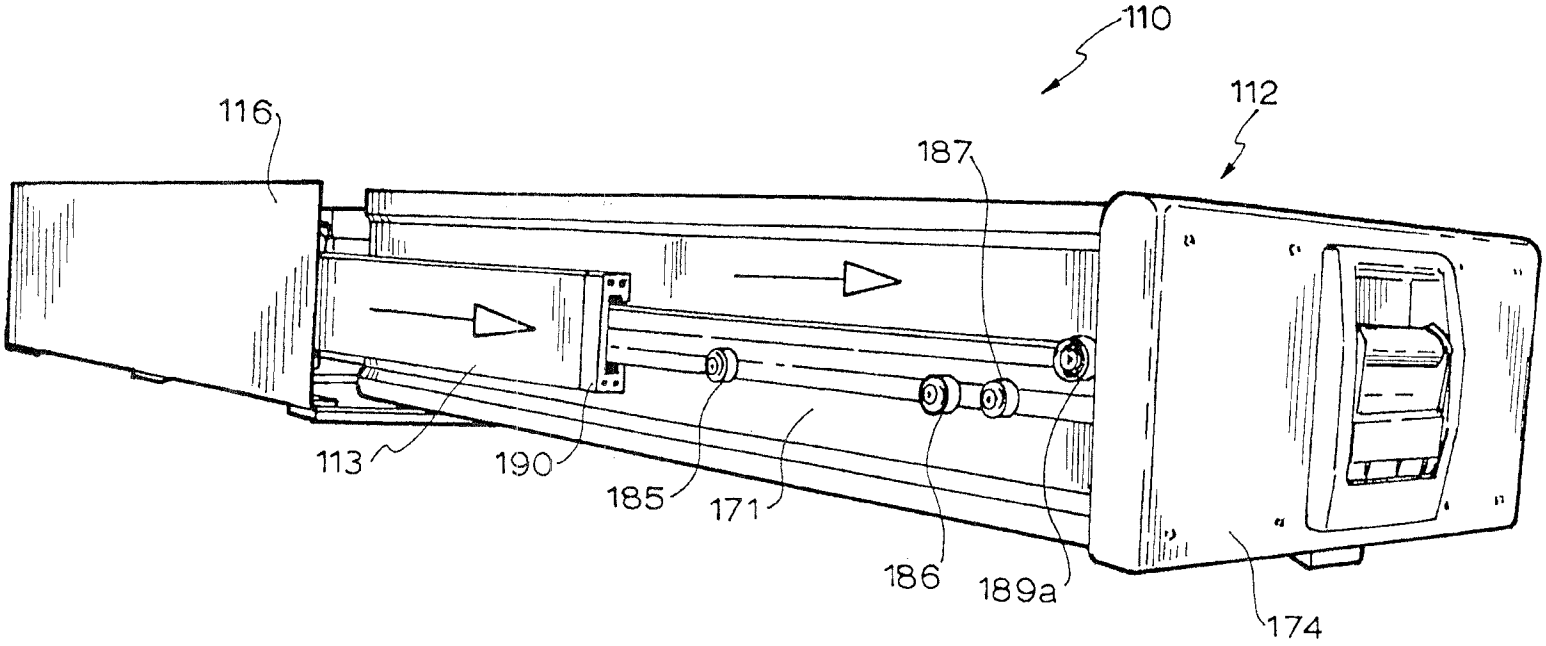
FIG. 12 is a pictorial representation of the drawer system of FIG. 6 from one side with the top cover wall removed for clarity and the drawer fully open with the outer end stoppers in place.

However, drawer 112 also has additional lower wheels 185, 186, 187 and 188 also mounted to the thickened portion as can be seen in FIG. 12. Advantageously, lower wheel 188 is close to wheel 182 and assists that wheel to transfer the drawer load to the runner when the drawer is fully extended. However wheel 188 also acts as a stopper wheel as will be described in more detail later. Wheels 186 and 187 being adjacent the front of the drawer only carry drawer load when the drawer is fully closed or at least almost fully closed thereby reducing the upward moment load on rear upper wheel 183 and the downward moment load on intermediate wheel 184 thus providing a significant improvement over cabinet system 10, at least during off road travel. Wheel 185 assists in carrying drawer load when the drawer is part drawn but also assists movement of the during closing by ramping into the track channel of the runner upon the drawer being pushed into the cabinet. Wheels 189*a* and 189*b* are stopper wheels similar in function to stopper wheels 148 and 149 of the cabinet side wall mentioned earlier and described below.

Figure 13:
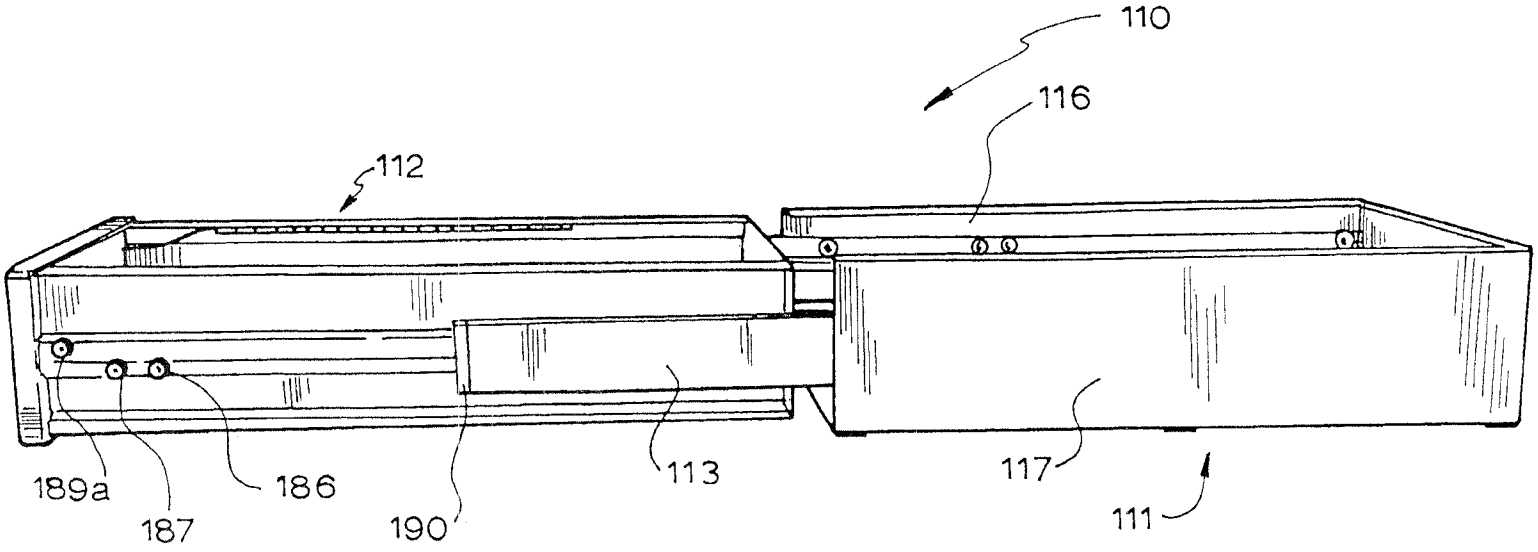
FIG. 13 is a pictorial representation of the drawer system of FIG. 6 with the top cover wall removed for clarity and the drawer fully open from the other side with the outer end stoppers in place.
Figure 14:
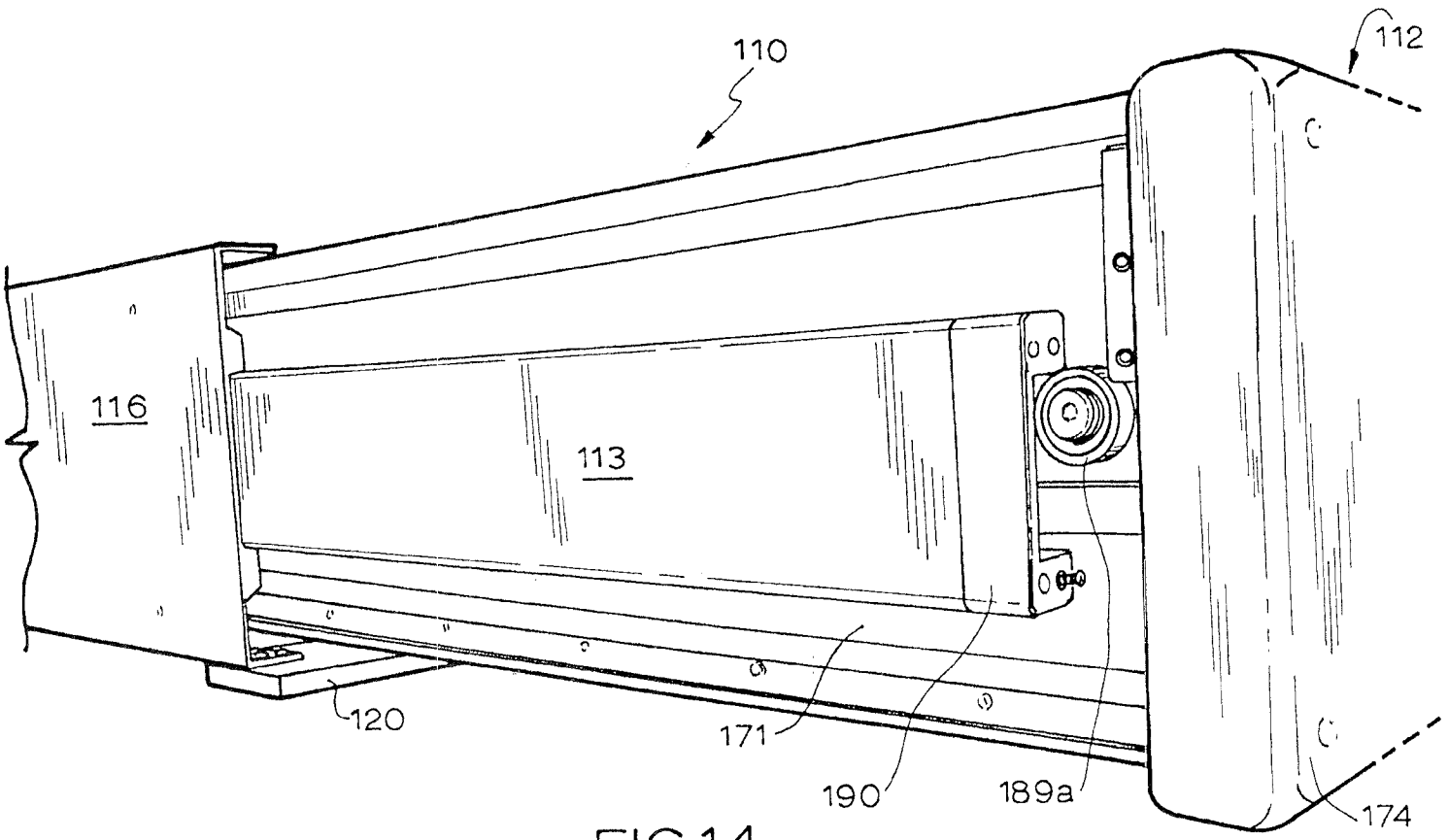
FIG. 14 is a pictorial representation of the drawer system of FIG. 6 with the top cover wall removed for clarity and the drawer half closed with the outer end stoppers in place.
Figure 15:
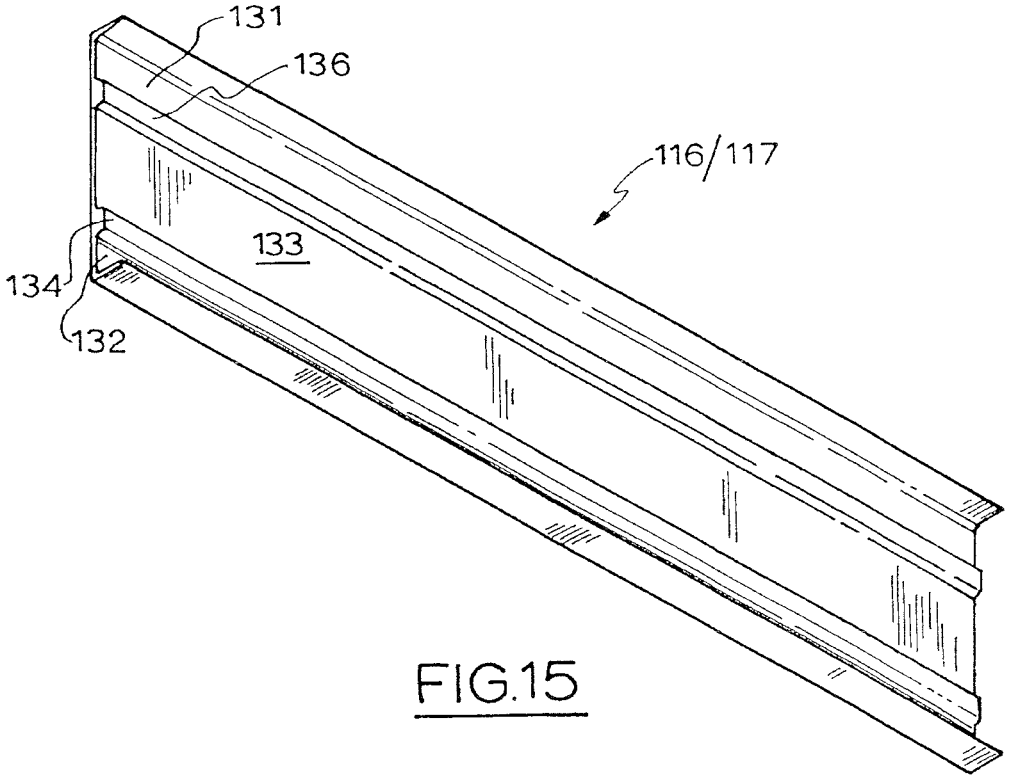
FIG. 15 is a cross sectional end elevation of the aluminium extrusion used to form the side walls of the cabinet shell of the cabinet system of FIG. 6.
Figure 16:
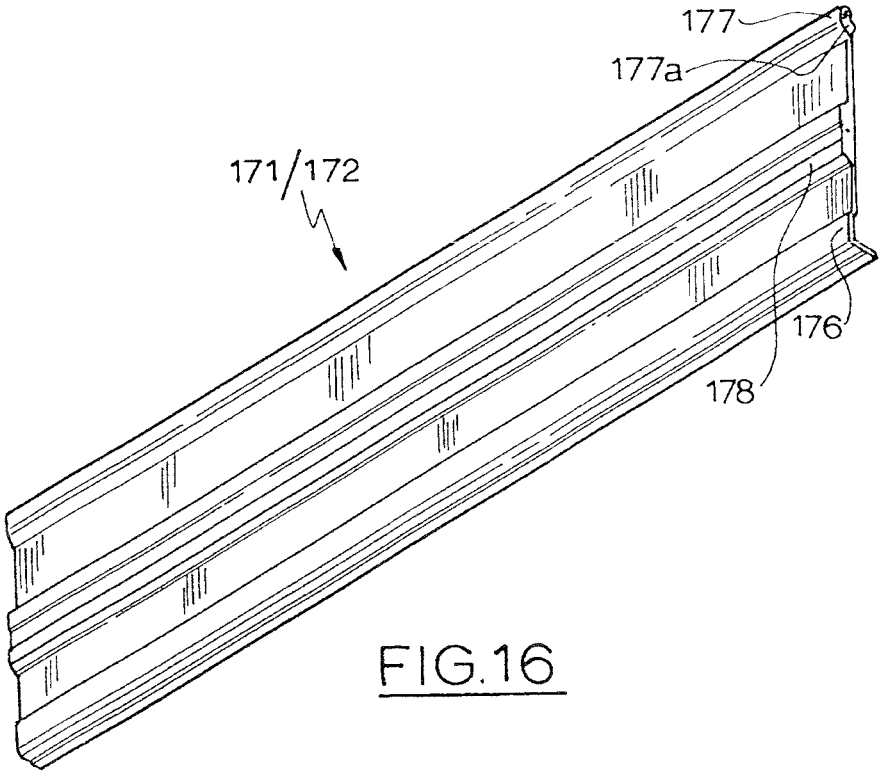
FIG. 16 is a cross sectional end elevation of the aluminium extrusion used to form the side panels of the drawer of the cabinet system of FIG. 6.
Figure 17:
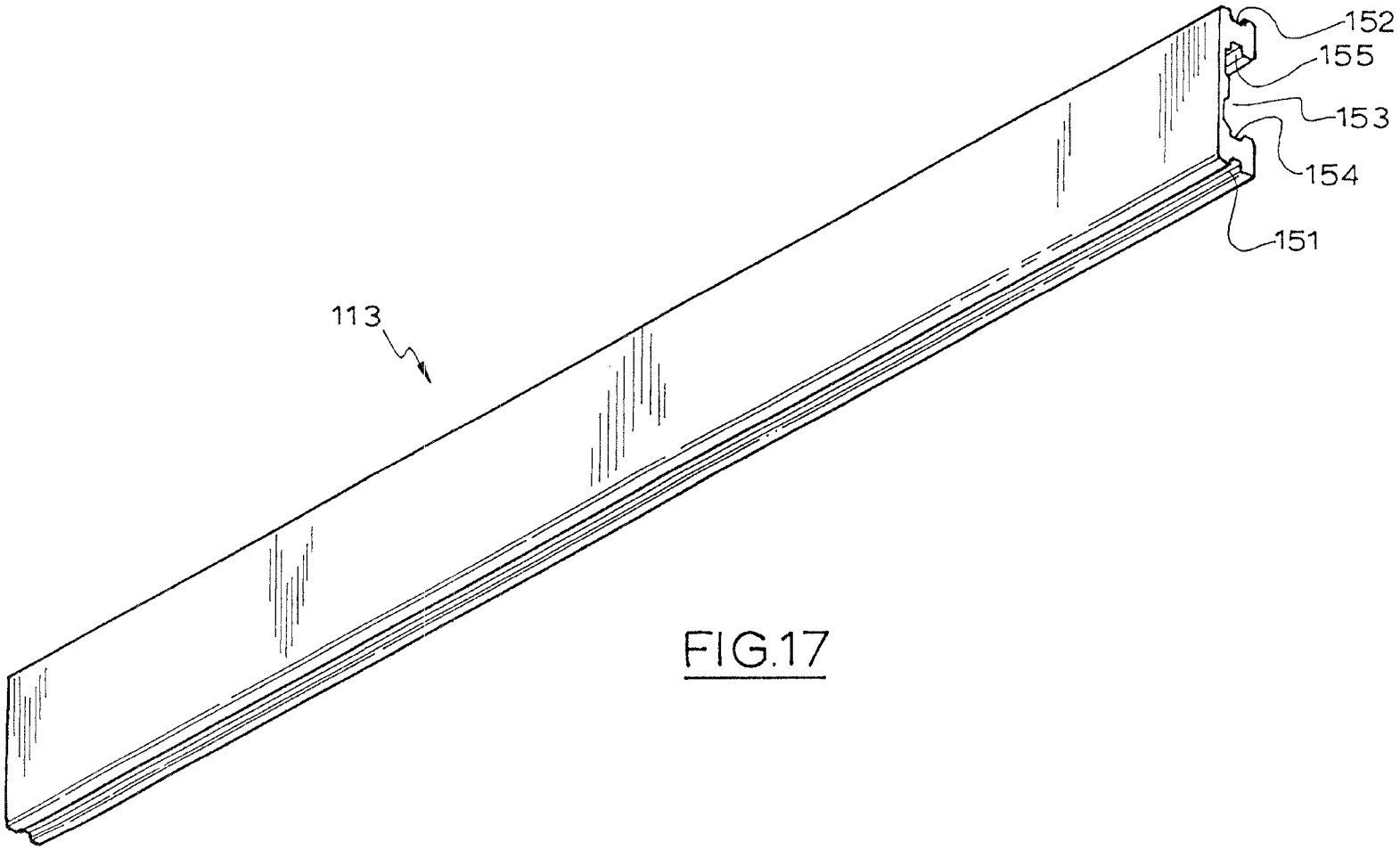
FIG. 17 is a cross sectional end elevation of the aluminium extrusion used to form the runners of the cabinet system of FIG. 6.

A rear end plug 190*a* is fitted to the runner 113 as can be seen in FIG. 8 and similarly a front end plug 190*b* is fitted to the front end of the runner after the runner has been fitted to the cabinet and the drawer to the runner as can be more clearly seen in FIGS. 12 to 14.

Figure 19:
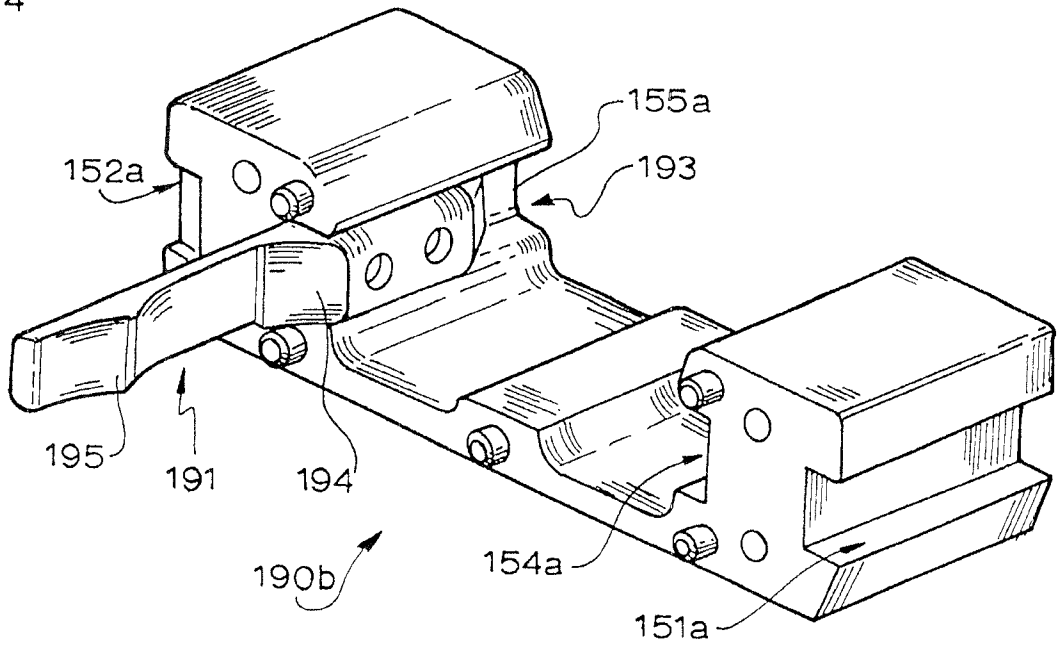
FIG. 19 is a pictorial representation of an end plug for the runners of the drawer system of FIG. 6 showing a stop mechanism on an inner track.
Figure 18:
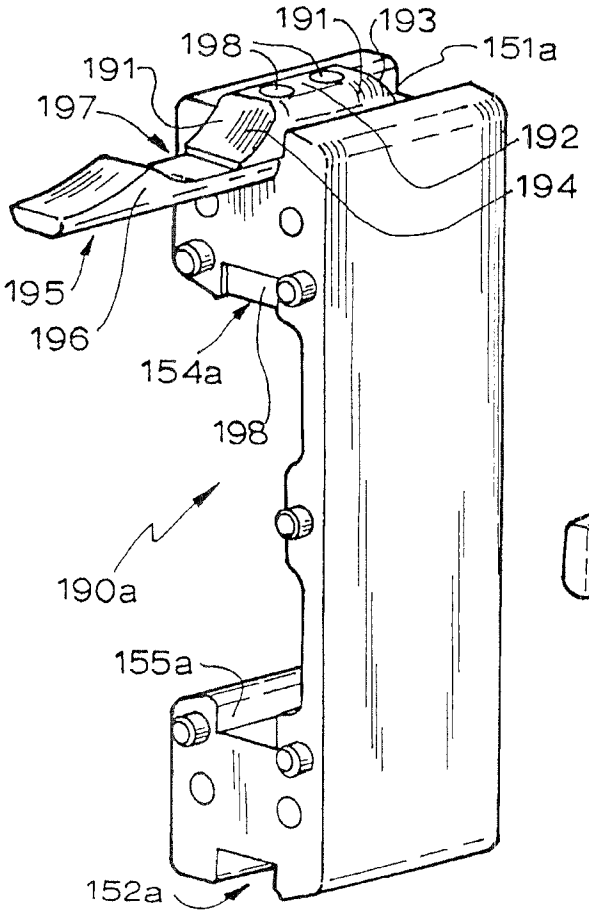
FIG. 18 is a pictorial representation of an end plug for the runners of the drawer system of FIG. 6 showing a stop mechanism on an outer track.

As can be seen more clearly in FIGS. 18 and 19, the end plug 190 includes outer track channels 151*a* and 152*a* and inner track channels 154*a* and 155*a* respectively which are arranged to align with the corresponding outer track channels 151 and 152 and inner track channels 154 and 155 respectively.

A stopper mechanism 191 is mounted in outer track channel 151*a* via a stopper block 192 which provides a curved end stop face 193 which is in the rear in this situation and an opposite curved front stop face 194 in this situation, the rear face being arranged such that cabinet upper rear wheel 149 can rest against it to prevent the drawer and the runner from travelling further into the cabinet than desired or hitting the cabinet rear wall too hard and the front face being arranged so that upper cabinet stopper wheel 148 can engage it to limit travel of the runner from the cabinet.

The front stopper is assisted by a second front stopper component 195 which includes an inclined protuberance 196 arranged to provide a wheel mountable bump on the track somewhat like a traffic speed bump. The protuberance is selected so that wheel 149 can roll over it under a predetermined opening force applied to the drawer or the runner and then engage with the inclined front face 194 of the stopper block 192 and rest in the valley 197 between the protuberance and the stopper block.

It will be appreciated that the wheel 148 can rollover the protuberance 196 in the reverse direction to release the drawer under a similar predetermined closing force. Advantageously, the stopper mechanism not only stops the runner from travelling beyond the open position but it also holds it in a specific fully extended position until a predetermined force is applied which encourages the drawer to close onto the runner before forcing the runner into the cabinet and vice versa.

The front plug 190*b* is similar to the rear plug 190*a* but as can be seen in FIG. 19, the stopper mechanism is mounted in the inside upper track channel with the front stopper fitted into the upper track channel 155 of the runner and is engaged by drawer upper wheel 184 when the drawer is fully open with stopper wheel 189*b* engaged with the face 193 (which becomes the front face) in this arrangement of the stopper mechanism when the drawer is fully closed or during closing where the drawer pushes the runner into the cabinet.

Figure 20:
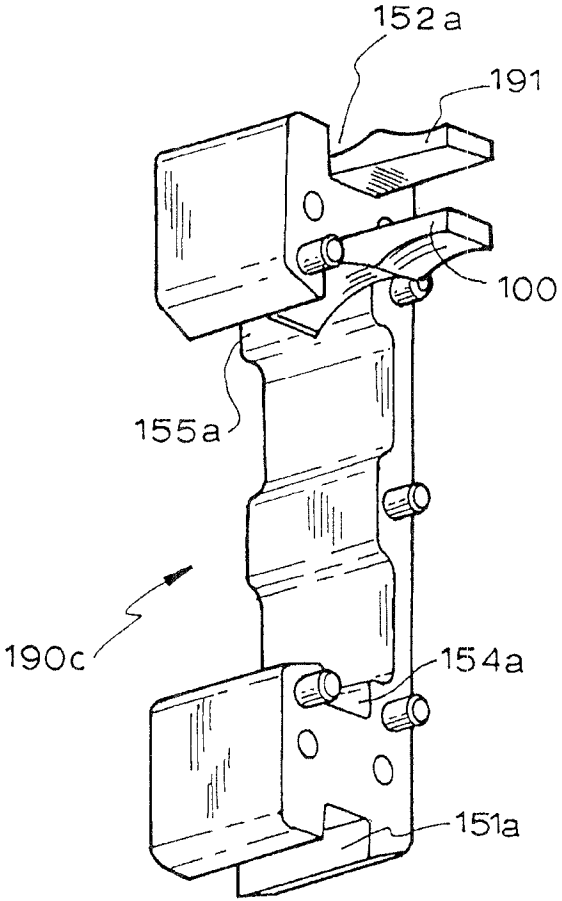
FIG. 20 is a pictorial representation of another end plug for the runners of the drawer system of FIG. 6 showing a stop mechanism on an inner track and an outer track.

If desired end cap 190*c* as illustrated in FIG. 20 with two stopper mechanisms 191 can be used in some situations if desired. Advantageously, such an end cap provides for the drawer to be "locked" to the runner subject to a predetermined opening force by stopper wheel 189*b* engaging with the inner stopper mechanism and the runner to be locked to the cabinet by engagement of locking wheel 148 with the outer locking mechanism as will be understood from the drawings and the previous description.

The latch handle 174 is recessed into the front drawer wall panel and includes a tongue which engages in a recess provided in the front cross member 120 and which is retracted by pulling handle 179*a* downwards.

Figure 11:
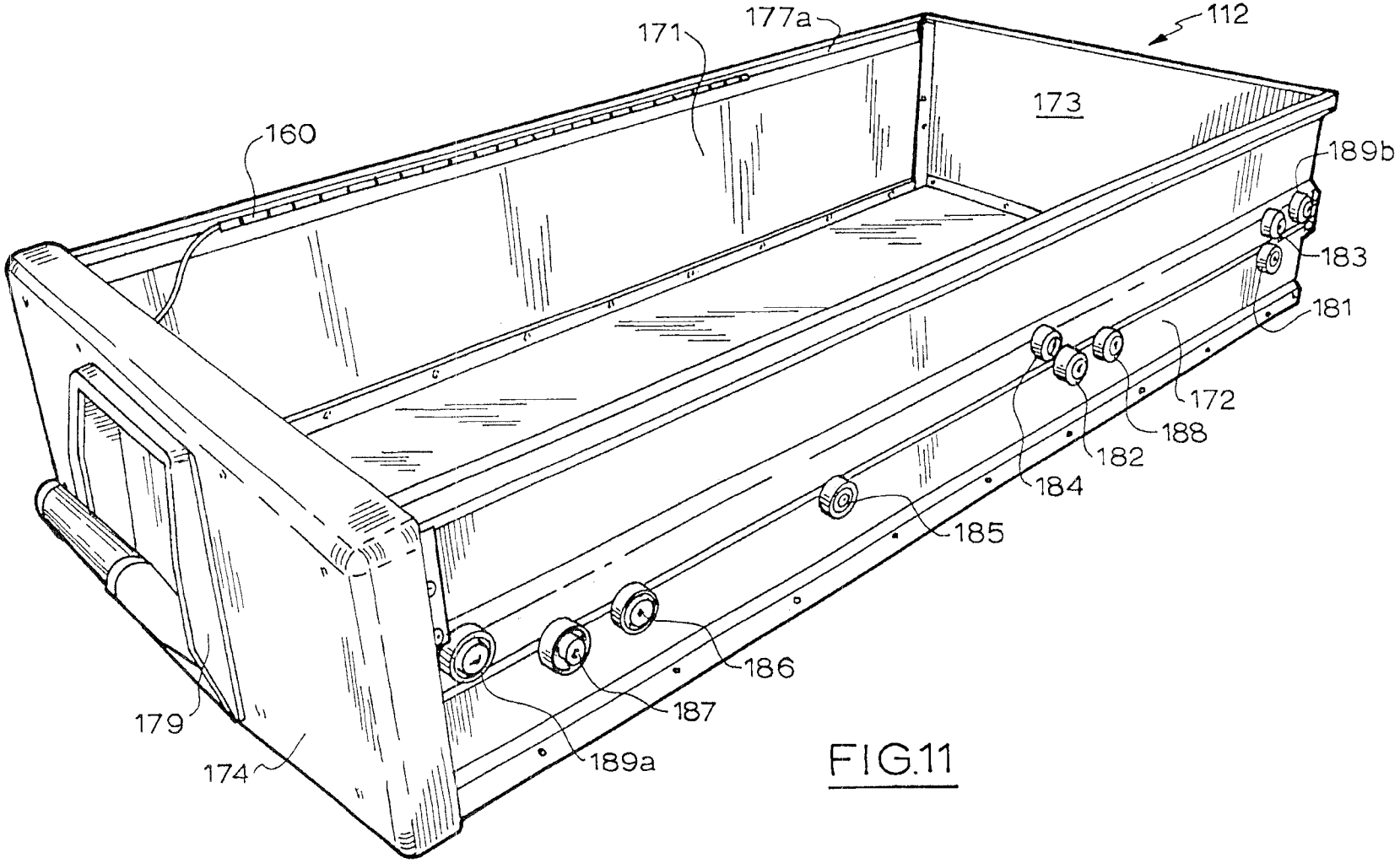
FIG. 11 is a pictorial representation of the drawer of the system of FIG. 6.

The cabinet drawer system 110 illustrated in the drawings also provides for lighting in the drawer. In that respect, an LED strip light 160 (that is a light emitting diode strip light) is mounted to one of the drawer side panels as can be seen in FIG. 11. In other forms of the invention strip lights can be mounted to both side panels as will be appreciated from FIG. 7*b*. It will be appreciated from FIGS. 7*a*, 7*b*, 11 and 16 that the strip light is mounted to face 177*a* which is inclined at approximately 45 degrees to the vertical and consequently the light is directed downwards into the drawer. Power for the light is provided by a rechargeable battery mounted in the front panel 174 which is connected to a charger via a socket in mounted in the front face of the front panel adjacent the handle 220. In use, the drawer 112 "slides" forward (outwards) relative to the shell in much the same manner as previously described in relation to drawer 10.

Figure 21:
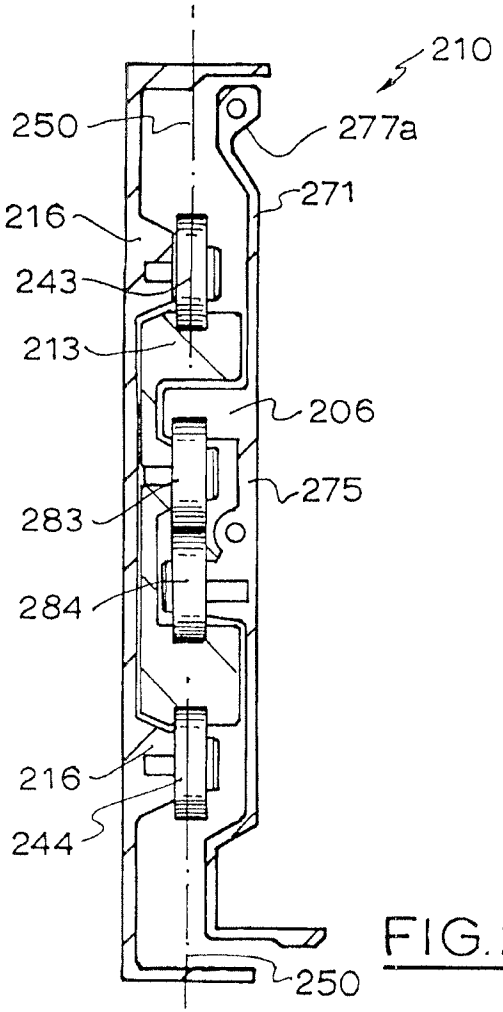
FIG. 21 is a sectional front elevation of part of another drawer system according to the invention with a different upper guide arrangement for the drawer from that used in the drawer cabinet system of FIG. 6.

The drawer system 210 illustrated in part in FIG. 21 is the same as the system illustrated in FIG. 6 in most respects and consequently the same reference numbers will be used herein to reference corresponding features or components where possible except prefaced by a "2" in place of the "1". In the previously described drawer systems, the upper guide means of the drawer were one or more wheels mounted to the drawer side panels and the complementary guide means of the runner was a track provided in a channel. However, in this system, the upper guide means of the drawer is a track provided in a channel formed in an outwardly extending protuberance portion of the drawer side panel while the complementary guide means of the runner is a wheel mounted thereto and arranged to engage with the track in the channel. Thus, it will be seen that the wheel and channel are effectively reversed in this system. A similar change could be made with respect to the upper guide means of the cabinet and the complementary guide means of the runner. However, the system described and illustrated in FIG. 6 provides advantages over the system of FIG. 21, one being that the runner is an unencumbered extrusion and all encumbrances such as wheels are fitted to either the cabinet side wall panel or the drawer side wall panel thereby having lower manufacturing costs, another being that the runner can be easily replaced, another being that the drawer side panel is a simpler extrusion.

Figure 22:
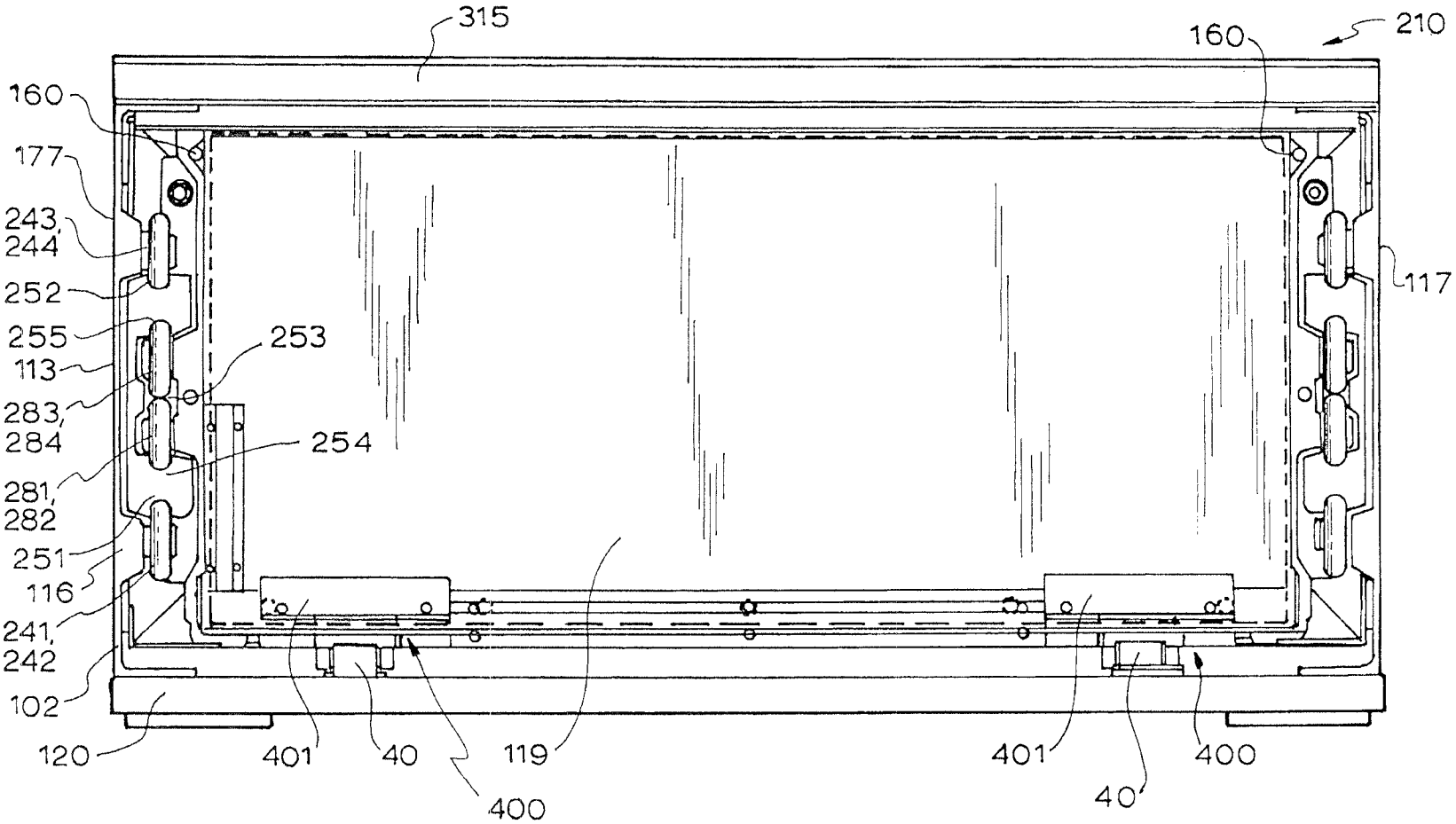
FIG. 22 is a sectional rear elevation of another drawer system according to the invention with different shaped wheels and different drawer stoppers or holders from those used in the drawer cabinet system of FIG. 6.

The drawer system 310 illustrated in FIG. 22 is the same as the system illustrated in FIG. 6 in most respects and consequently the same reference numbers will be used herein to reference corresponding features or components where possible and the features which differ will be prefaced by a "3" in place of the "1".

Figure 23:
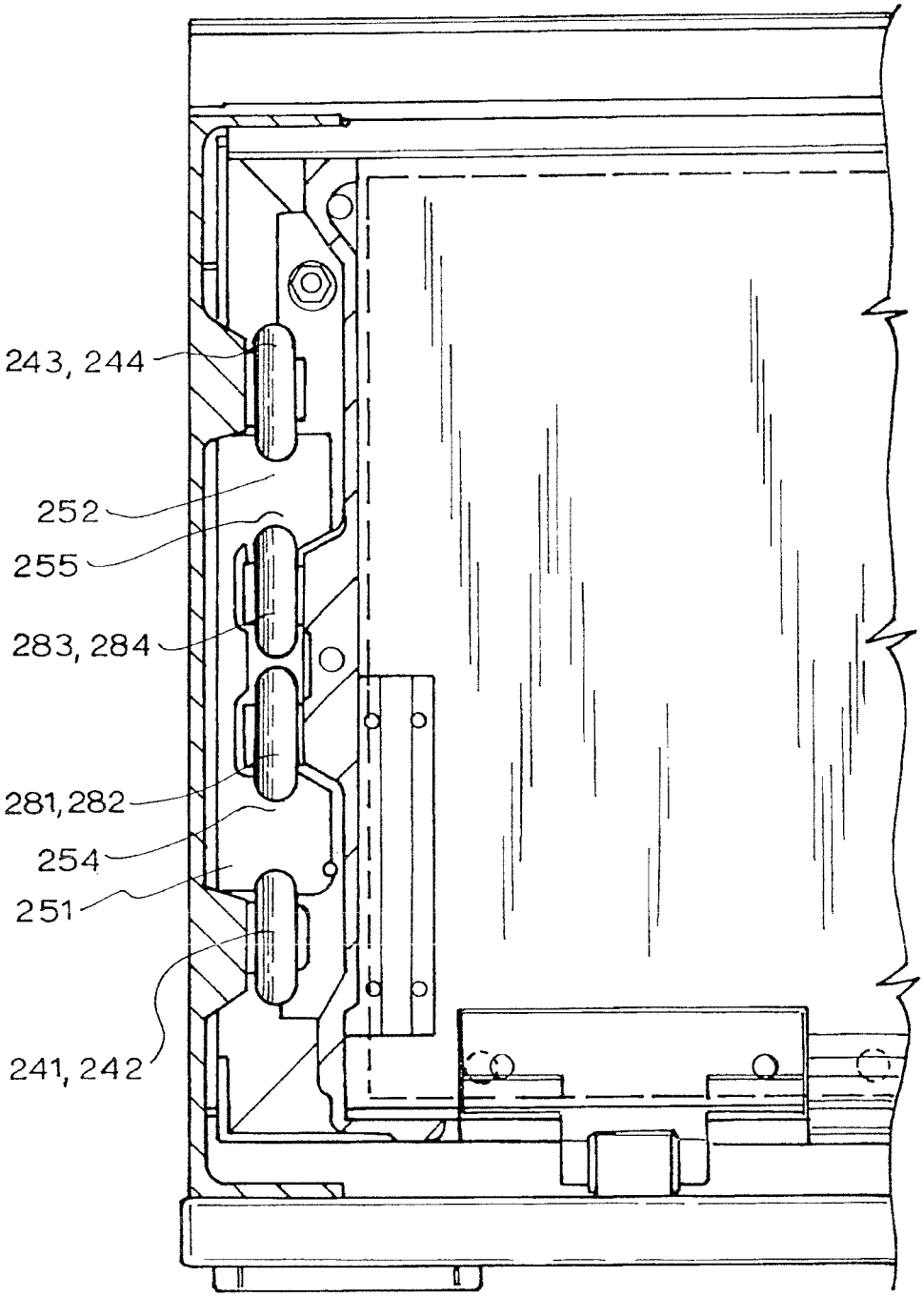
FIG. 23 is an enlarged sectional front elevation of part of the drawer system of FIG. 22.

There are three main points of difference in drawer system 310 over drawer system 110. The first is that the wheels 241 to 244 and 281 to 284 have an arcuate running surface and run on complementary arcuate tracks as foreshadowed earlier in this specification. As can be seen in FIGS. 22 and 23, the "tread" portion of the wheels is semicircular in cross section such that the diameter of the wheels increases from the side faces to the centre plane thereby giving a convex tread portion which is adapted to run in complementary concave recesses 251, 252, 254 and 255 respectively. Advantageously, as can be more clearly seen in FIG. 23, the depth of each recess is selected such that only the convex tread portion of the wheels runs in the recess so that the side walls are clear of the recess and consequently cannot bind therewith. Moreover, the complementary convex treads together with the concave track result in the drawer being self-aligning in the cabinet.

The other main difference is that drawer system 310 has a different stopper system from drawer 210. In that respect, in Drawer system 210 the stoppers were mounted on the runner. Drawer system 210 includes two stoppers which are mounted separately from the tracks and serve as switches for the interior LED strip light 160.

Figure 24:
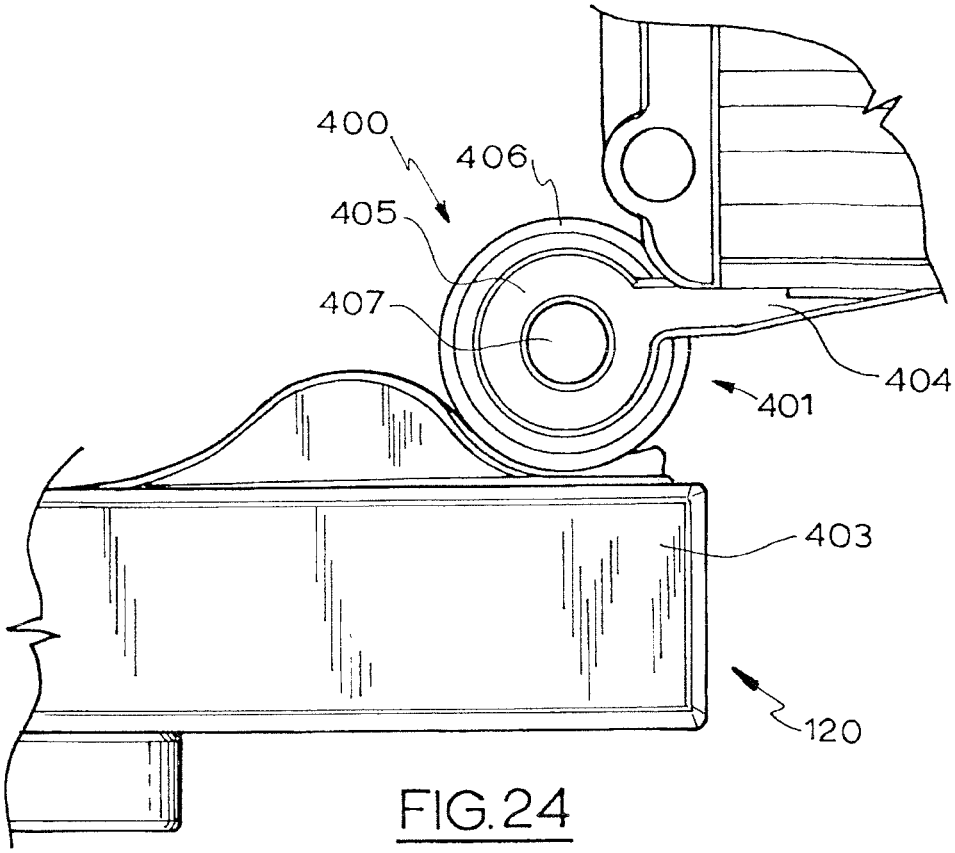
FIG. 24 is an enlarged sectional end elevation of part of the drawer system of FIG. 22 when the drawer is in the open position.
Figure 25:
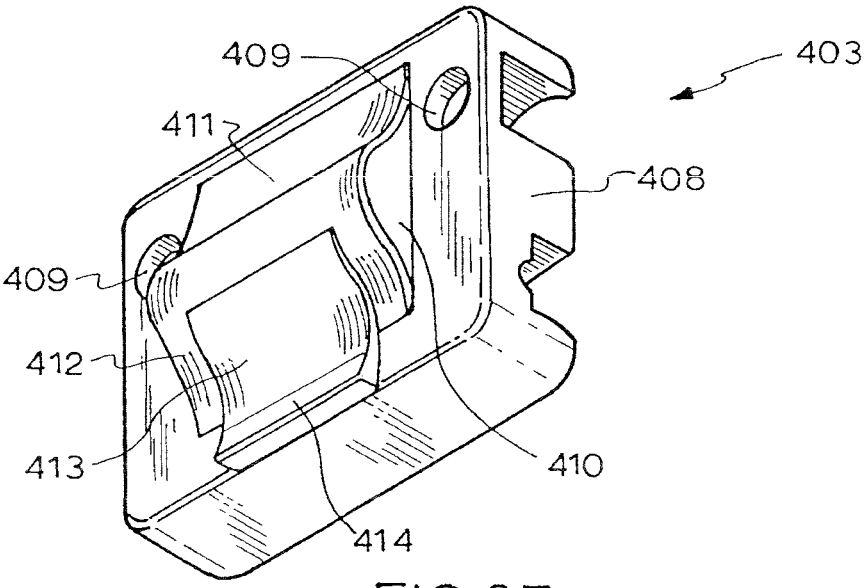
FIG. 25 is a pictorial representation of one of the stopper or holder components of the drawer system of FIG. 22.
Figure 26:
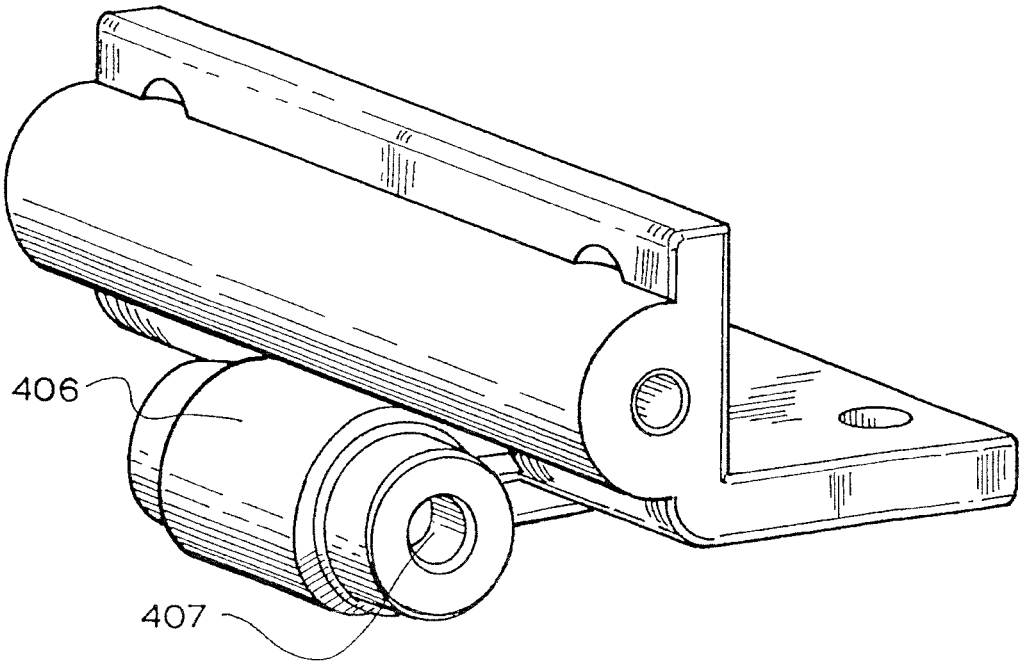
FIG. 26 is a pictorial representation of another one of the stopper or holder components of the drawer system of FIG. 22.

As can be seen in FIG. 24, the stopper system (or holder system) is arranged to stop forward movement of the drawer out of the cabinet and hold it in the outer open position and includes two spaced apart stopper units 400. Each stopper/holder unit includes two main components, a first component 401 mounted to the drawer (the drawer half) and a second component 403 mounted to front cross member 120 or the floor of the cabinet in cases where a floor is provided instead of cross members (the cabinet half).

The drawer half includes a mounting bracket 404 formed or non-conductive plastics material (although in other embodiments it is formed of metal encapsulated in an insulating material) which is fastened to the back wall and bottom wall of the drawer by screws or bolts or other suitable fixing means, and a wheel made of a conductive material wheel which is mounted on an axle such as a bolt (not shown) passing through bores or passages 407 in the bracket for rotation relative thereto.

The cabinet half 403 includes a mounting bracket 408 which is fixed to the cross member 120 by screws or bolts extending through bores 409. The mounting bracket includes a stopper block 410 integrally formed therewith shaped as a longitudinal hump with a sloping lead face 411 and a similarly sloping exit face 112. A resting pad 413 formed of an electrical conductive material, preferably brass or aluminium is secured to the exit face and includes a stopper portion 414 at its exit end.

Suitably, the two halves are mounted such that as the drawer approaches the fully open position, the wheel 406 rolls up the lead face of the stopper block thereby lifting the rear end of the drawer slightly and rides over the hump and comes to rest on the resting pad against the stopper portion 414. Because there are two laterally spaced apart stopper units across the drawer and cabinet, the drawer lifts evenly as the wheels ride up the lead faces. It will be appreciated that another set of cabinet halves may be mounted at predetermined positions between the front of the cabinet and the rear of the cabinet to hold the drawer in other predetermined positions if desired.

Advantageously, the stopper system also serves as a switch system for connecting the LED lights in the drawer to the vehicle power supply.

In that respect, a conductive wheel of one drawer unit is connected by electrical cable to one terminal of the LED light and the other wheel to the other terminal of the light. Similarly, when the cabinet is installed in a vehicle, the resting pad of one cabinet unit is connected by electrical cable to one terminal of the vehicle battery and the resting pad of the other cabinet unit is connected to the other terminal of the vehicle battery. The arrangement is such that when the drawer is opened to the predetermined position whereby the conductive wheels rest on the resting pads, the circuit is completed and the light turns on. Advantageously, the switch arrangement allows the drawer to be opened and closed without requiring any movement or dragging of a power supply cable and moreover results in the light being on only in predetermined drawer positions and consequently, the danger of the drawer lights being left on and running down the vehicle battery accidentally is substantially reduced while at the same time ensuring that the light in the drawer is powered when needed.

It will be appreciated that while single drawer systems have been described, the invention can be used for multi drawer systems with side by side drawers or systems with drawers one above the other. Advantageously, the cabinets previously described can be simply mounted side by side and secured to each other or stacked one on top of the other and secured to each other. Alternatively, cabinet side walls of double height or triple height could be extruded in the same general form to accommodate multiple drawers.

The cabinet drawer system of the present invention provides many advantages over the currently available drawer systems. Firstly, the cabinet and drawer side walls comprise extruded aluminium panels which are designed to withstand heavy loads when used in vehicles being driven over rough terrain and to resist posting and bending. The side panels and the runner I designed so that they all into re-engage thereby minimising the space taken up by those panels thereby maximising drawer space. The side panels of the cabinet and the drawer form part of the slide mechanism in themselves so that a separate slide system is not required. The sliding system allows the drawer to extend completely beyond the cabinet thereby providing full upward access to the drawer.

The foregoing description has been given by way of illustrative example of the invention and many modifications and variations which will be apparent to persons skilled in the art may be made without departing from the spirit and scope of the invention as hereinbefore described.

What is claimed is:

1. An elongate extruded panel for a drawer cabinet, the panel having a side wall portion for forming the side wall of the cabinet and spaced apart top and bottom wall portions extending from said side wall portion substantially orthogonal thereto and contiguous therewith for connecting top and bottom wall panels of the cabinet thereto, said side wall portion including a thin middle portion and two spaced apart parallel upper and lower thicker portions defining a longitudinal recess or channel therebetween bounded on one side by said thin middle portion.

2. An elongate extruded panel according to claim 1, wherein said longitudinal recess or channel and said spaced apart top and bottom wall portions are on the same side of said thin middle portion.

3. An elongate extruded panel according to claim 2, including a recess or channel between said bottom wall portion and said lower thicker portion.

4. An elongate extruded panel according to claim 1, including a recess or channel between said top wall portion and said upper thicker portion.

5. An elongate extruded panel according to claim 1, wherein the panel is formed of aluminium.

6. An elongate extruded panel for a drawer, the panel having a side wall portion for forming the side wall of the drawer and a bottom wall portion extending from said side wall portion substantially orthogonal thereto and contiguous therewith for connecting a bottom wall panel of the drawer thereto, said side wall portion terminating in a top lip portion spaced from said bottom wall portion, said top lip portion having an upper face and a lower face, said lower face facing downwards, and said side wall portion including a thin upper portion and a thin lower portion extending in opposite directions from a thicker intermediate portion adapted to have wheels mounted thereto.

7. An elongate extruded panel for a drawer according to claim 6, wherein said lower face faces downwards at an acute angle to said side wall portion.

8. An elongate extruded panel according to claim 6, wherein said top lip portion extends from said side wall portion in a direction generally opposite to said bottom wall portion.

9. An elongate extruded panel for of a drawer according to claim 8, wherein said lower face faces downwards at an angle selected for a strip light mounted thereon to shine light downwards and sidewards from said bottom wall portion.

10. An elongate extruded panel according to claim 8, wherein said lower face is in a recess.

* * * * *